US007708273B2

(12) United States Patent
Nireki

(10) Patent No.: US 7,708,273 B2
(45) Date of Patent: May 4, 2010

(54) PAPER SHEET PROCESSING APPARATUS

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 12/257,899

(22) Filed: Oct. 24, 2008

(65) Prior Publication Data

US 2009/0121415 A1 May 14, 2009

(30) Foreign Application Priority Data

Oct. 24, 2007 (JP) ..... 2007-276602

(51) Int. Cl.
*B65H 5/00* (2006.01)
*B65H 5/02* (2006.01)

(52) U.S. Cl. ..... 271/264; 271/273; 271/265.01; 271/240

(58) Field of Classification Search ..... 271/264, 271/273, 274, 265.01, 240
See application file for complete search history.

(56) References Cited

U.S. PATENT DOCUMENTS

| | | | | |
|---|---|---|---|---|
| 5,564,544 | A | 10/1996 | Takemoto et al. | |
| 6,199,856 | B1 | 3/2001 | Clauser et al. | |
| 2005/0029075 | A1* | 2/2005 | Suzuki | 194/207 |
| 2005/0045449 | A1* | 3/2005 | Nago et al. | 194/207 |
| 2005/0077215 | A1 | 4/2005 | Nago et al. | |
| 2005/0183926 | A1* | 8/2005 | Deaville et al. | 194/206 |
| 2006/0115312 | A1 | 6/2006 | Furihata et al. | |
| 2008/0073835 | A1* | 3/2008 | Embury et al. | 271/264 |
| 2008/0128241 | A1* | 6/2008 | Deaville et al. | 194/206 |
| 2008/0190730 | A1* | 8/2008 | Smith et al. | 194/206 |
| 2009/0057094 | A1* | 3/2009 | Nireki | 194/206 |
| 2009/0107798 | A1* | 4/2009 | Nireki | 194/206 |

FOREIGN PATENT DOCUMENTS

| | | |
|---|---|---|
| JP | 2002-279487 | 9/2002 |
| JP | 2005-115811 | 4/2005 |

OTHER PUBLICATIONS

U.S. Appl. No. 12/257,899, filed Oct. 24, 2008, Nireki.
U.S. Appl. No. 12/255,970, filed Oct. 22, 2008, Nireki.

* cited by examiner

*Primary Examiner*—David H Bollinger
(74) *Attorney, Agent, or Firm*—Oblon, Spivak, McClelland, Maier & Neustadt, L.L.P.

(57) ABSTRACT

A paper sheet processing apparatus including: an insertion slot into which a paper sheet is inserted, a paper sheet conveyance mechanism for conveying the paper sheet inserted into the insertion slot, a paper sheet traveling route through which the paper sheet is conveyed, a sensor for detecting the paper sheet existence in the paper sheet traveling route, a pair of contact members for holding the paper sheet, a driving source for moving one of the pair of contact members toward the other, and a control device for controlling driving of the driving source. Either of the pair of contact members is driven to convey the paper sheet. The control device controls the driving force to move either of the pair of contact members such that the pair of contact members are kept apart before the paper sheet is inserted and that the pair of contact members become closer to each other.

13 Claims, 17 Drawing Sheets

PAPER SHEET PROCESSING APPARATUS

CROSS REFERENCE TO RELATED APPLICATIONS

This application is based upon and claims the benefit of priority from Japanese Patent Application No. 2007-276602 filed on Oct. 24, 2007, the entire contents of which are incorporated herein by reference.

FIELD OF THE INVENTION

The present invention relates to a paper sheet processing apparatus including a paper sheet conveyance mechanism that conveys a paper sheet inserted from an insertion slot.

RELATED ART

For example, a paper sheet processing apparatuses that processes a paper sheet such as a bill is incorporated into a service providing device, such as a game medium lending machine installed in a game hall, a vending machine or a ticket-vending machine installed in the public space, or the like, that identifies the validity of a paper sheet (bill) inserted from an insertion slot by a user in a paper sheet identification part (a bill identification part or bill validator), and provides various types of products and services in accordance with a value of the paper sheet judged as valid. In such a paper sheet processing apparatus, as disclosed in Japanese patent application publication No. 2005-115811, for example, a paper sheet conveyance mechanism that conveys a paper sheet inserted into an insertion slot toward the paper sheet identification part is installed.

Typically, as disclosed in Japanese patent application publication No. 2005-115811, the paper sheet conveyance mechanism includes a pair of conveyor rollers that hold (or nip) an inserted paper sheet therebetween to convey it toward the downstream side, and when an entrance sensor installed in the back of the insertion slot detects the paper sheet insertion, the paper sheet conveyance mechanism drives the pair of conveyor rollers to hold (or nip) the paper sheet therebetween to convey it toward the inside of the apparatus.

Then, as described above, in a typical paper sheet processing apparatus, when a user inserts a paper sheet into an insertion slot, an entrance sensor installed at an insertion slot portion detects the insertion, and the paper sheet processing apparatus drives a pair of conveyor rollers so as to hold (or nip) the paper sheet therebetween on the downstream side to hold (or nip) the paper sheet therebetween and convey it toward the downstream side.

SUMMARY OF THE INVENTION

A paper sheet processing apparatus comprises: an insertion slot into which a paper sheet is inserted; a paper sheet conveyance mechanism for conveying the paper sheet inserted into the insertion slot; a paper sheet traveling route through which the paper sheet is conveyed by the paper sheet conveyance mechanism; a sensor for detecting the paper sheet existing in the paper sheet traveling route; a pair of contact members for holding the paper sheet inserted into the insertion slot; a driving source for moving one of the pair of contact members toward the other; and a control device for controlling driving of the driving source. Here, at least either of the pair of contact members is driven to convey the paper sheet by the paper sheet conveyance mechanism. And the control device controls the driving force to move the at least either of the pair of contact members such that the pair of contact members are kept apart from each other before the paper sheet is inserted into the insertion slot and that the pair of contact members become closer to each other so as to hold the paper sheet when the sensor detects that the paper sheet is inserted into the insertion slot.

Further features of the present invention, its nature, and various advantages will be more apparent from the accompanying drawings and the following description of the preferred embodiment.

DETAILED DESCRIPTION OF THE PREFERRED EMBODIMENT

Hereinafter, an embodiment of the present invention will be described with reference to the drawings. In the following embodiment which will be described in detail, a paper sheet or the like may be treated and described as a bill. Therefore, in the following description of the embodiment, a "paper sheet" will be described as a "bill" and a "paper sheet processing apparatus" will be described as a "bill processing apparatus." Therefore, the "paper sheet" generally includes the "bill" such that the paper sheet processing device includes the bill processing device.

Figure 1:
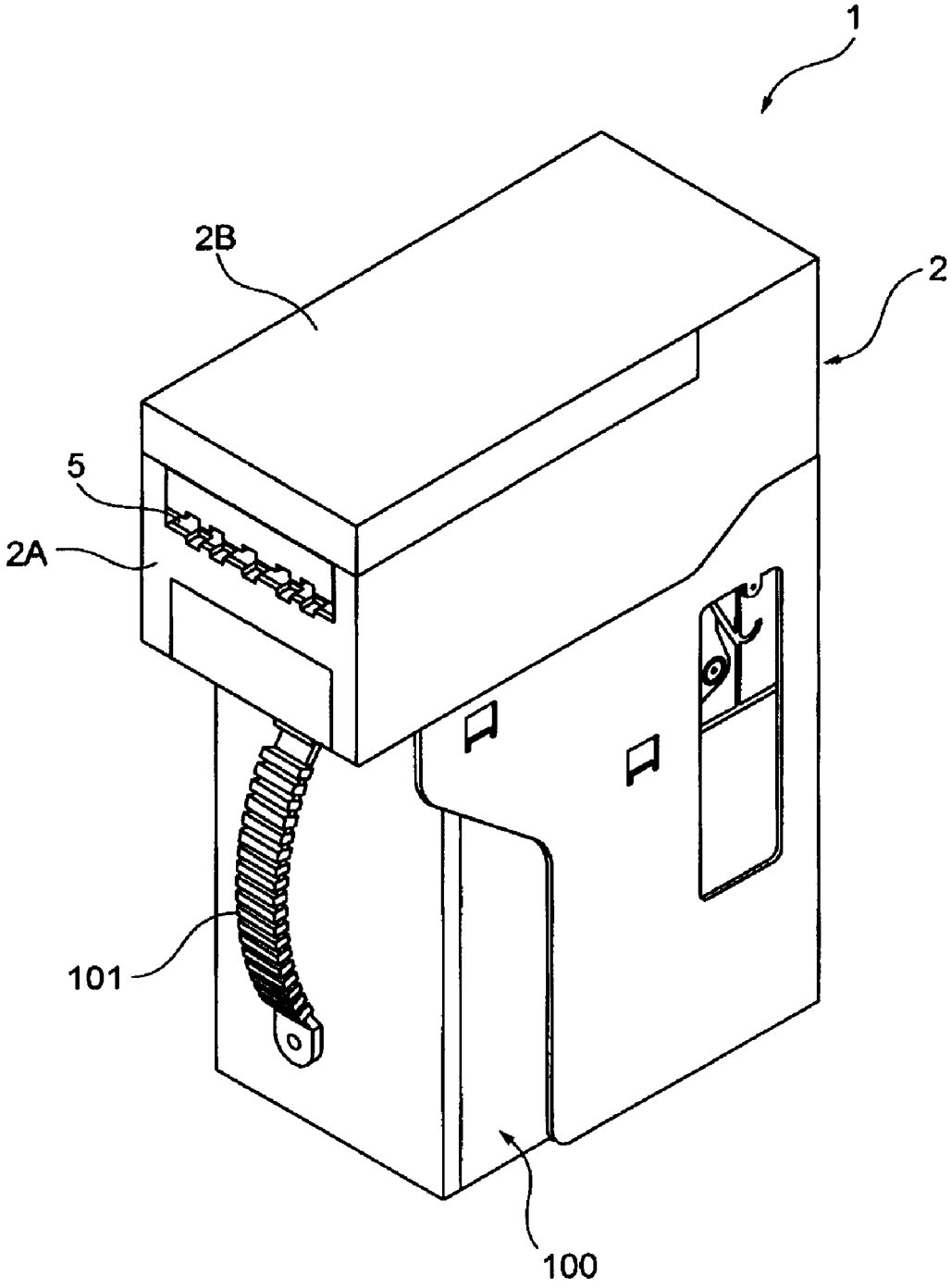
FIG. 1 is a perspective view showing an entire structure to illustrate a configuration of a paper sheet processing apparatus as a bill processing apparatus of an embodiment of the present invention.
Figure 2:
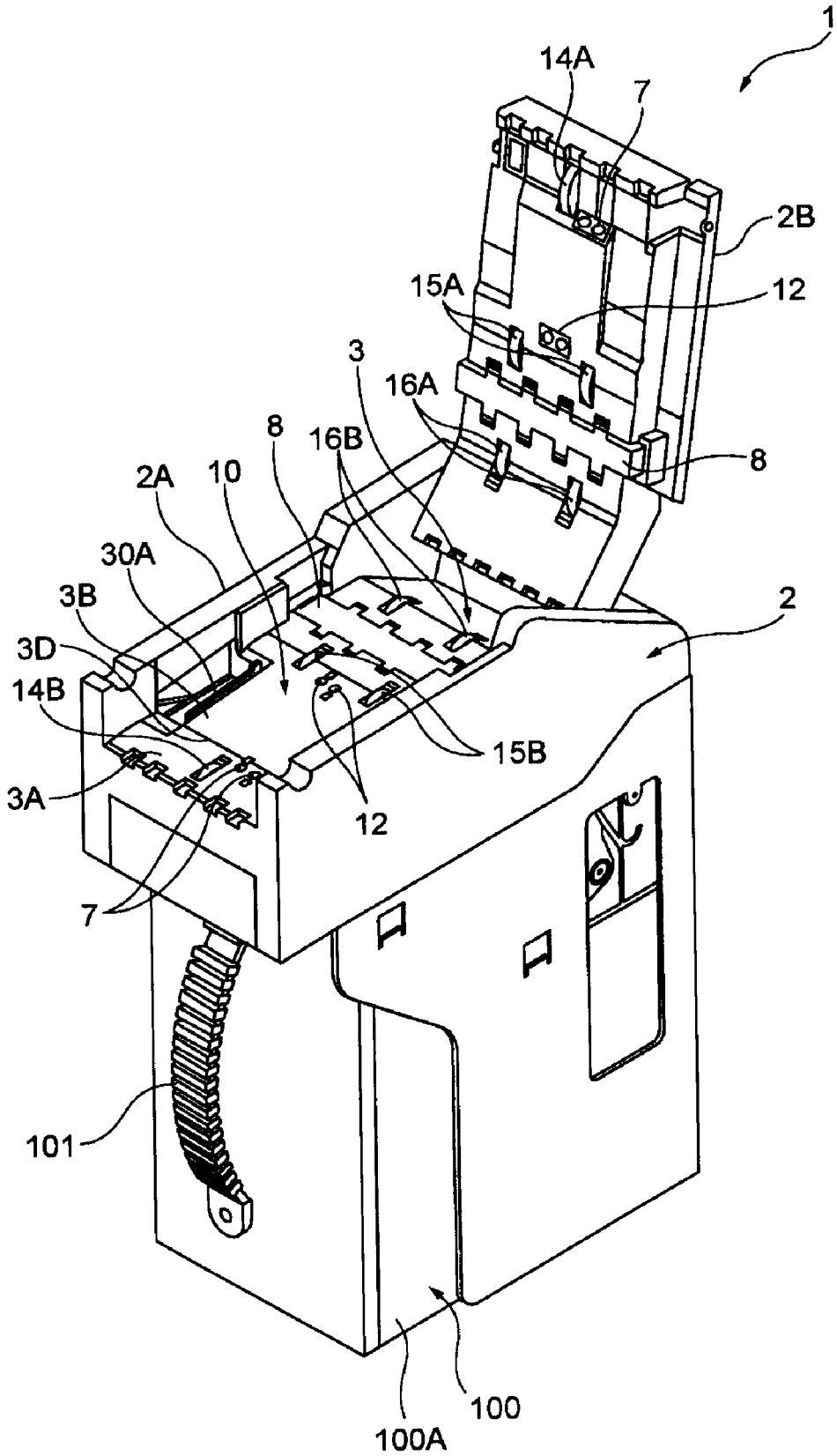
FIG. 2 is a perspective view showing the paper sheet processing apparatus in a state where an open/close member is opened for a main body frame of an apparatus main body.
Figure 3:
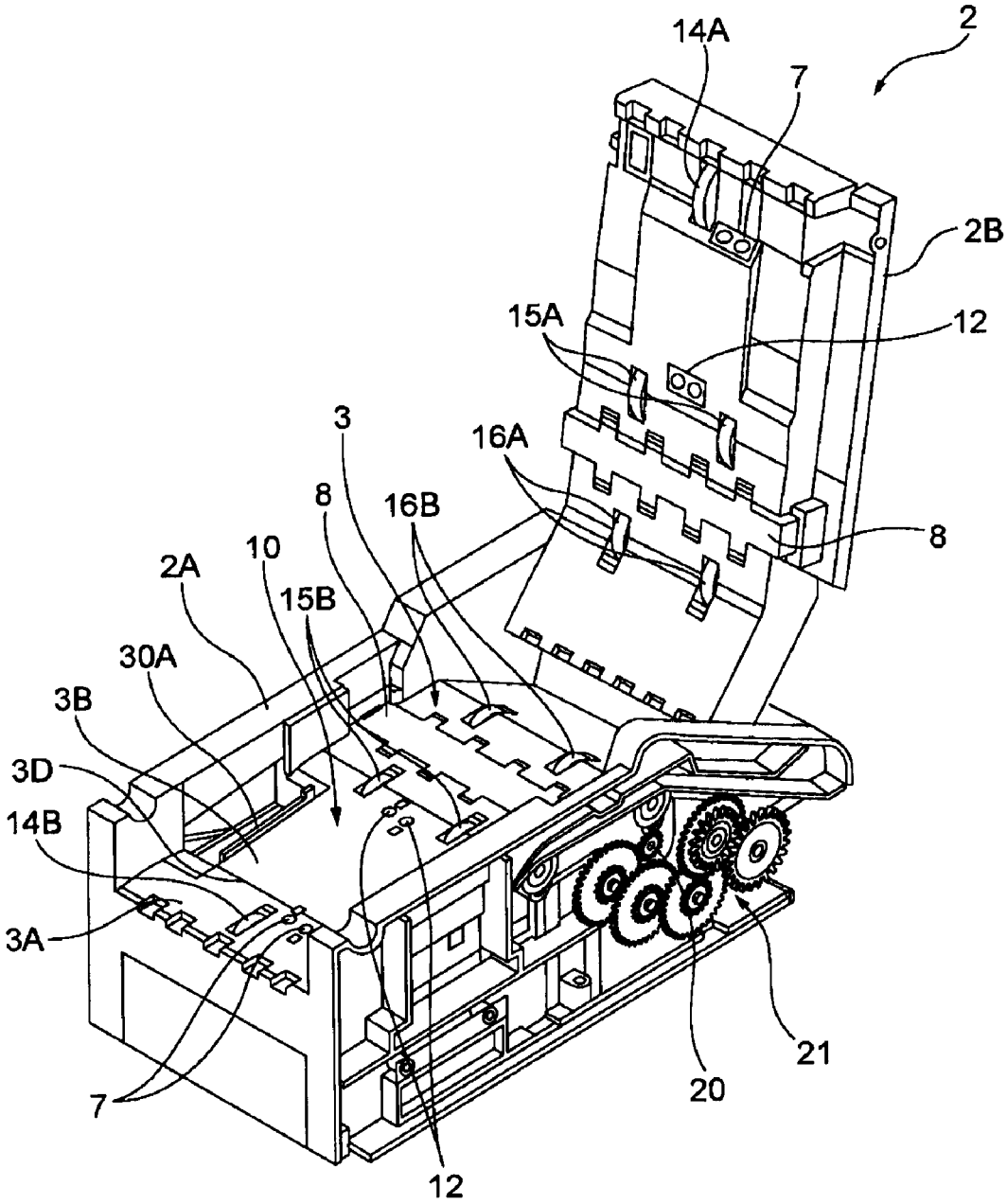
FIG. 3 is a perspective view showing a configuration of a power transmission part of the apparatus main body.
Figure 4:
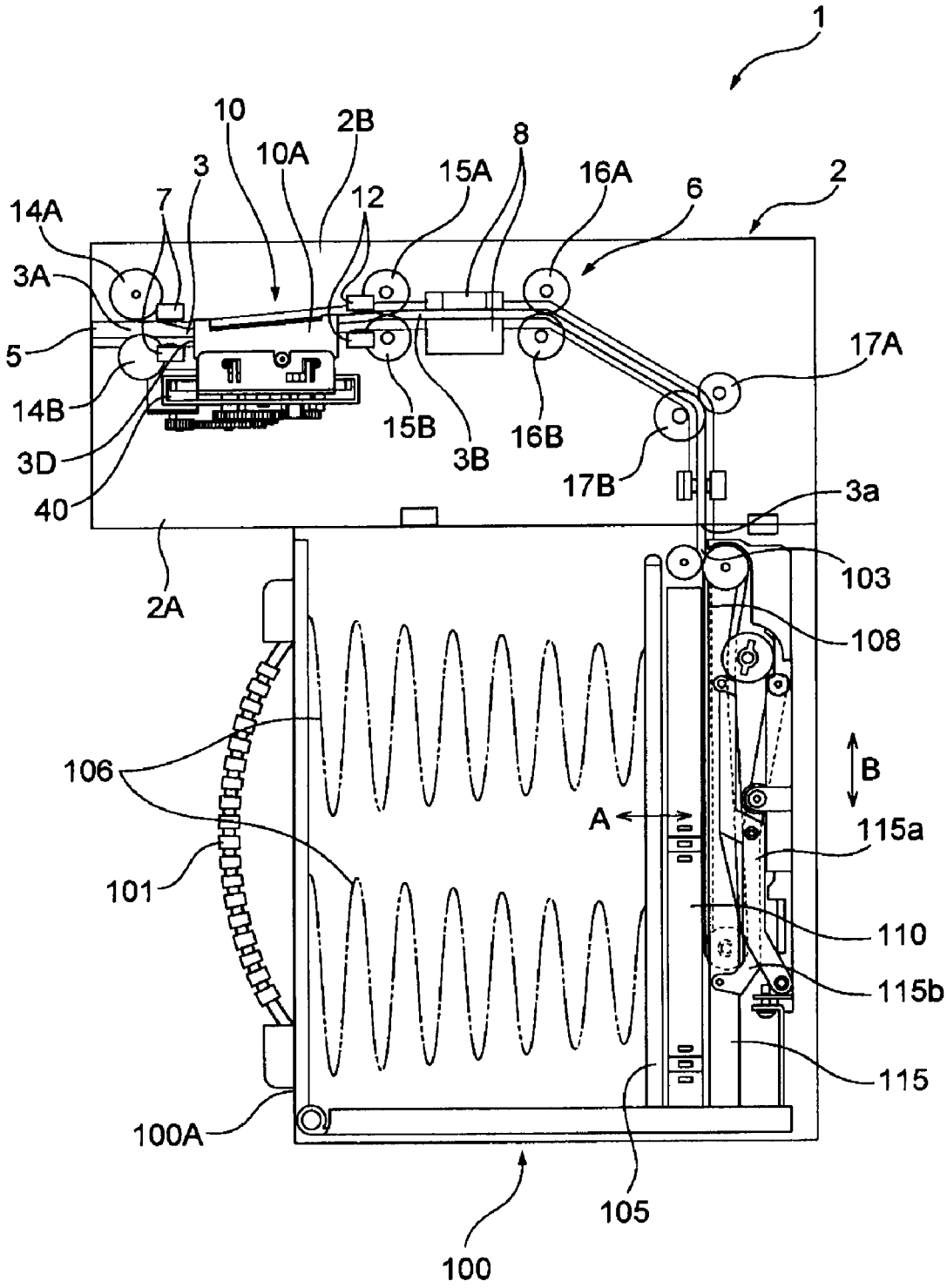
FIG. 4 is a right side view schematically showing a traveling route of a bill to be inserted from an insertion slot.
Figure 5:
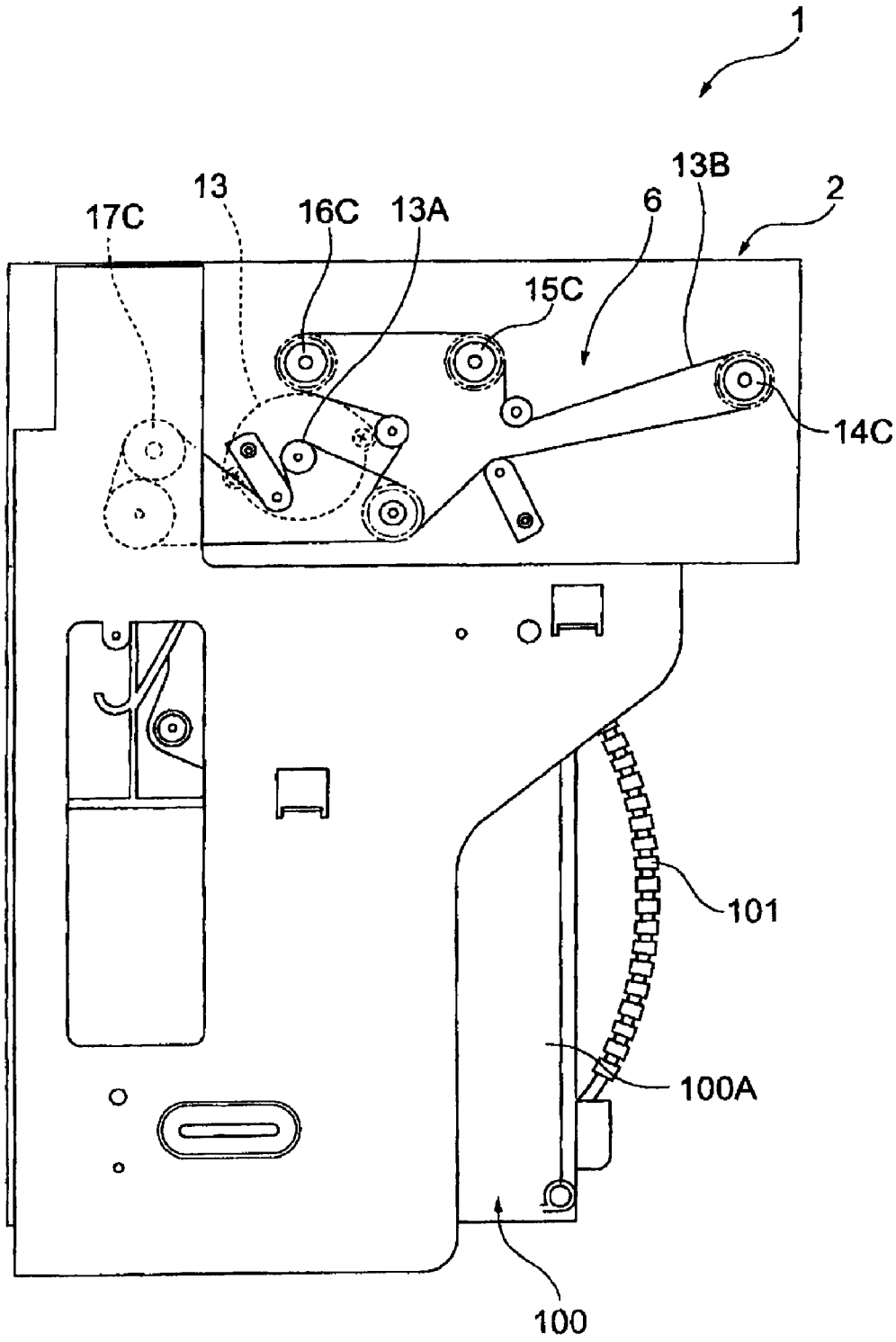
FIG. 5 is a left side view showing a schematic configuration of a driving source and a driving force transmission mechanism to drive a bill conveyance mechanism.
Figure 6A:
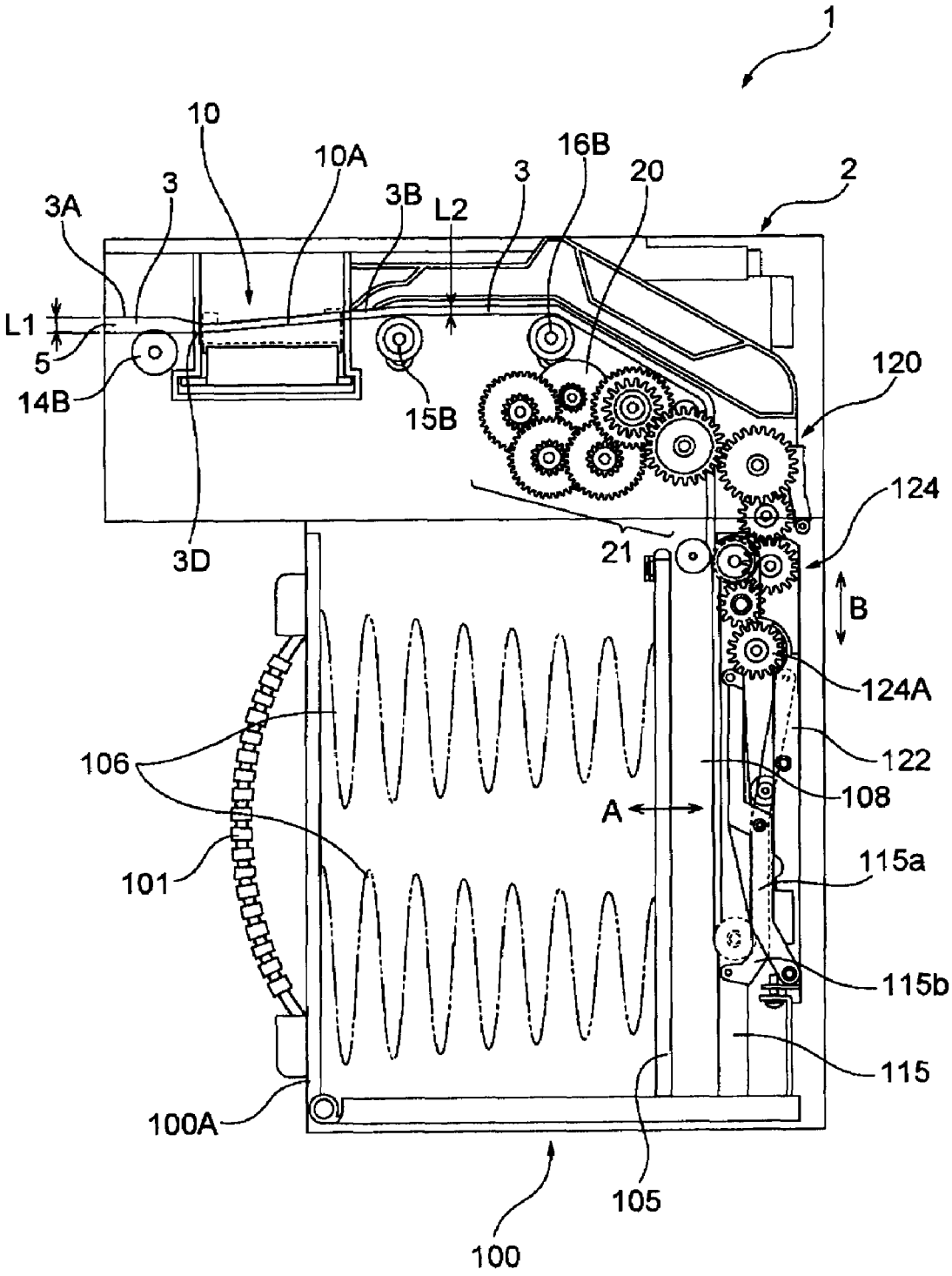
FIG. 6A is a diagram showing a schematic configuration of the driving force transmission mechanism to drive a presser plate installed in a bill stacker.

FIGS. 1 to 6A are diagrams showing a configuration of a paper sheet processing apparatus as a bill processing apparatus according to the present embodiment. FIG. 1 is a perspective view showing the entire structure. FIG. 2 is a perspective view showing a state in which an open/close member is opened for a main body frame of an apparatus main body. FIG. 3 is a perspective view showing a structure of a power transmission part of the apparatus main body. FIG. 4 is a right side view schematically showing a traveling route for a bill to be inserted from an insertion slot. FIG. 5 is a left side view showing a schematic structure of a driving source and a driving force transmission mechanism to drive a bill conveyance mechanism. FIG. 6A is a diagram showing a schematic structure of a driving force transmission mechanism to drive a presser plate installed in a bill housing part.

A bill processing apparatus 1 of this embodiment is configured to be incorporable into, for example, various types of game machines such as slot machines, and the bill processing apparatus 1 includes an apparatus main body 2 and a bill housing part (e.g., bill stacker or cashbox) 100 which is provided on the apparatus main body 2, and is capable of laminating and housing a great number of bills. In this case, the bill housing part 100, which has a function as a cashbox or safe, may be removable from the apparatus main body 2, and for example, in a state in which an unillustrated lock mechanism is released, the bill housing part 100 can be detached, in this embodiment, from the apparatus main body 2 by pulling a handle 101 provided on the front face thereof.

As shown in FIGS. 2 and 3, the apparatus main body 2 has a main body frame 2A and an open/close member 2B configured to be opened and closed with its one end as a rotating center with respect to the main body frame 2A. Then, as shown in FIG. 4, the main body frame 2A and the open/close member 2B are configured to form a space (bill traveling route) 3 through which a bill is carried at a portion at which both face each other when the open/close member 2B is closed with respect to the main body frame 2A, and to form a bill insertion slot 5 so as to correspond to the bill traveling route 3 at the front face exposed side of both. In addition, the bill insertion slot 5 is a slit-like opening from which a short side of a bill can be inserted into the inside of the apparatus main body 2.

The bill traveling route 3 is formed by the main body frame 2A and an open/close member 2B as described above, and in the present embodiment, the bill traveling route 3 is constituted of a first traveling route 3A provided so as to be connected to the bill insertion slot 5, and a second traveling route 3B extending toward the downstream side from the first traveling route 3A.

The first traveling route 3A is formed in a region in which a pair of contact members to be described later is arranged, the pair of contact members comprising a pair of rollers to be described later. The first traveling route 3A is a portion into which a bill is inserted by an operator. Further, the second traveling route 3B is formed on a downstream side from the leading end position at which a skew correction mechanism 10 to be described later is arranged.

Then, as shown in FIG. 6A, a length L1 in a bill thickness direction of the first traveling route 3A is set to be longer than a length L2 in a bill thickness direction of the second traveling route 3B. Further, a joint portion of the first traveling route 3A and the second traveling route 3B is bent by a predetermined angle (the bent portion is denoted by a reference symbol of 3D). Here, the bent portion 3D may be arranged at any position on the upstream side of bill reading means 8 (e.g., bill reading device) to be described later.

Figure 6B:
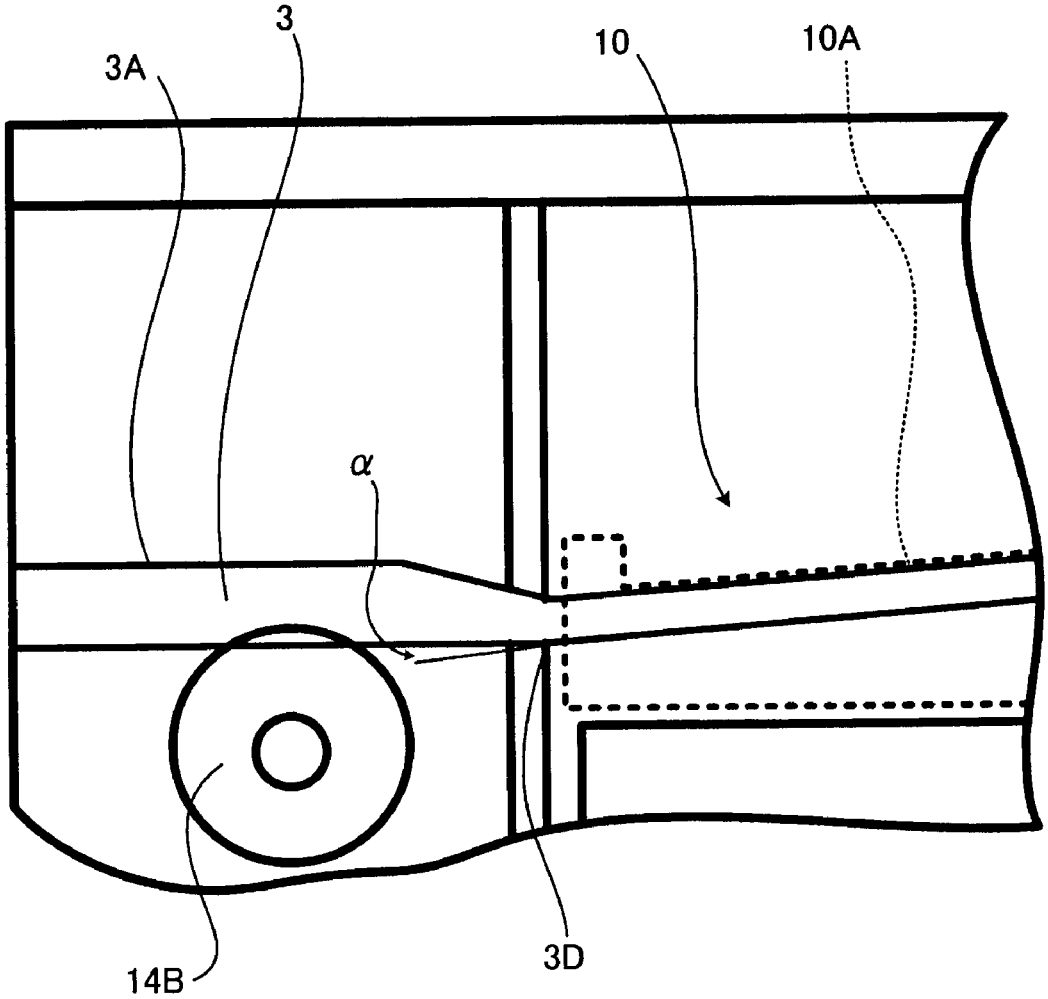
FIG. 6B is a partial enlarged diagram showing a schematic configuration of a bent portion shown in FIG. 6A.

FIG. 6B is a partial enlarged view of a bent portion 3D as shown in FIG. 6A. As described above, the first traveling route 3A and the second traveling route 3B are jointed with a crossing angle of $\alpha$ such that the bill or a thin rigid plate is prevented from passing through the traveling route as the distance from the insertion slot 5 to the bent portion is longer and the height L1 of the traveling route is smaller such that it is difficult to pass beyond the joint portion.

More specifically, if the height at the bent portion 3D of the boundary between the first traveling route 3A and the second traveling route 3B is given by H, a straightened bill (paper money) can go beyond the bent portion 3D by the length of $L=H/\tan(\alpha)$, provided that the thickness of the bill is negligible and the bill is not inserted in an inclined manner by utilizing the height of the first traveling route 3A. Therefore, it is preferable that the distance from the bent portion 3D to the bill reading means 8 is made equal to or longer than twice of L. On safer side, it is preferable that the distance from the bent portion 3D to the bill reading means 8 is made equal to or longer than three times of L. However, if it is too long, the apparatus tends to be big such that the distance may be adjusted for the purpose.

As a matter of course, the bill traveling route 3 may have a constant length in the paper sheet thickness direction along the bill traveling direction, and may not have such a bent portion therein.

In the apparatus main body 2, a pair of contact members (14A and 14B) to hold (or nip) a bill inserted from the bill insertion slot 5 therebetween, a contact member driving mechanism 70 to move the pair of contact members apart or close with each other so as to hold (or nip) the bill therebetween, a bill conveyance mechanism 6 to convey the bill, an insertion detecting sensor 7 to detect the bill having been inserted into the bill insertion slot 5, the bill reading means 8 (including a bill reading device) installed on a downstream side of the insertion detecting sensor 7, which reads information from the bill in a traveling state, the skew correction mechanism 10 to accurately position and convey the bill to the bill reading means 8, a movable piece passage detecting sensor 12 to detect the bill passing through movable pieces constituting the skew correction mechanism 10, and control means 200, which includes a control device, (e.g., control circuit board 200A; refer to FIG. 12) for controlling the drives of the contact member driving mechanism 70, the bill conveyance mechanism 6, the bill reading means 8, and the skew correction mechanism 10 are provided.

Hereinafter, the aforementioned respective components will be described below in detail.

As described above, the bill traveling route 3 extends from the bill insertion slot 5 toward the inside and comprises the first traveling route 3A and the second traveling route 3B. On the downstream side of the second traveling route 3B, it is bent so as to be inclined downward such that the route is eventually bent in the vertical direction. A discharge slot 3*a* from which the bill is discharged to the bill housing part 100 is formed in the second bill traveling route 3B, and the bill discharged therefrom is fed into a feed port (acceptance port) 103 of the bill housing part 100 in the vertical direction.

The pair of contact members may be configured to be capable of holding (or nipping) and conveying an inserted bill therebetween, and moving apart from each other. And in the present embodiment, the pair of contact members comprises a pair of rollers (14A and 14B). Then, the roller 14A of the pair of rollers which is arranged on the upper side is driven to become close to or apart from the other roller 14B which is arranged on the lower side by the contact member driving mechanism 70 to be described later, and the roller 14B arranged on the lower side is driven to rotate so as to convey the bill. In this case, the roller 14B is driven to rotate together with the conveyor roller arranged along the bill traveling route 3 by the bill conveyance mechanism 6.

The bill conveyance mechanism 6 is a mechanism capable of carrying a bill inserted from the bill insertion slot 5 along the inserting direction, and of feedback-carrying a bill in an inserted state toward the bill insertion slot 5. The bill conveyance mechanism 6 includes a motor 13 (refer to FIG. 5) serving as a driving source installed in the apparatus main body 2, and conveyor roller pairs (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed to the bill traveling route 3, and all the pairs are rollers in which the conveyor rollers 15B, 16B, and 17B installed on the underside of the bill traveling route 3 are driven by the motor 13, and the conveyor rollers 15A, 16A, and 17A installed on the upper side are pinch-rollers driven according to these rollers.

In addition, the conveyor roller pair (14A and 14B) as the contact members that first hold (or nip) a bill inserted from the bill insertion slot 5 therebetween, to carry it to the back side is, as shown in FIGS. 2 and 3, installed at one place at the center position of the bill traveling route 3, and the conveyor roller pairs (15A and 15B), (16A and 16B), and (17A and 17B) which are disposed in the order at the downstream side thereof are respectively disposed at two places with predetermined intervals along the width direction of the bill traveling route 3.

Further, with regard to the roller pair (14A and 14B), the upper roller 14A is normally set in a state where it is spaced from the lower roller 14B. When an insertion of the bill is detected by the insertion detecting sensor 7, the upper roller 14A is driven toward the lower conveyor roller 14B by the contact member driving mechanism 70 to hold (or nip) the inserted bill therebetween.

Then, when a process for eliminating skew of an inserted bill and positioning the bill with respect to the bill reading means 8 (skew correction process) is executed by the skew correction mechanism, the upper conveyor roller 14A is spaced from the lower conveyor roller 14B to release the load on the bill, and when the skew correction process is completed, the upper conveyor roller 14A is driven to move toward the lower conveyor roller 14B again to hold (or nip) the bill therebetween. The skew correction mechanism 10 comprises a pair of right and left movable pieces 10A (only one side is shown) that eliminates skew, and drives a motor 40 for skew driving mechanism to perform a skew eliminating process.

The conveyor rollers 15B, 16B, and 17B installed on the underside of the bill traveling route 3 and the lower conveyor roller 14B constituting the contact members are, as shown in FIG. 5, driven to rotate by the motor 13 and pulleys 15C, 16C, 17C, and 14C installed at the ends of the driving shafts of the respective conveyor rollers. That is, a driving pulley 13A is installed on the output shaft of the motor 13, and a driving belt 13B is wrapped around the pulleys 15C, 16C, 17C, and 14C installed at the ends of the driving shafts of the respective conveyor rollers as well as around the driving pulley 13A. In addition, tension pulleys are engaged at appropriate positions with the driving belt 13B, which prevents it from loosening.

In accordance with the structure described above, when the motor 13 is driven to normally rotate, the conveyor rollers 15B, 16B, and 17B and the roller 14B are driven to normally rotate in synchronization therewith to convey the bill toward the insertion direction. When the motor 13 is driven to reversely rotate, the conveyor rollers 15B, 16B, and 17B and the roller 14B are driven to reversely rotate in synchronization therewith to convey the bill toward the bill insertion slot 5 side.

The insertion detecting sensor 7 is to generate a sensed signal when a bill inserted into the bill insertion slot 5 is sensed. In the present embodiment, the pair of conveyor roller (14A and 14B) is installed between the bill insertion slot 5 and the insertion detecting sensor 7. In this case, the insertion detecting sensor 7 is constituted of, for example, an optical sensor such as a regressive reflection type photo sensor. However, the insertion detecting sensor 7 may be constituted of a mechanical sensor other than an optical sensor.

Further, the movable piece passage detecting sensor 12 is to generate a sensed signal when it is sensed that a front end of the bill passes between a pair of left and right movable pieces constituting the skew correction mechanism 10, and the movable piece passage detecting sensor 12 is installed on the upstream side of the bill reading means (or bill reading device) 8. The movable piece passage detecting sensor 12 is also constituted of an optical sensor or a mechanical sensor in the same way as the aforementioned insertion detecting sensor.

The bill reading means 8 reads bill information on the bill carried in a state in which the skew is eliminated by the skew correction mechanism 10 (and the bill is accurately positioned), and judges validity (authenticity) thereof. In detail, for example, the bill reading means 8 may be constituted of a line sensor that performs reading of the bill such that the bill to be carried is irradiated with light on both sides, and transmitted light therethrough and reflected light therefrom are detected by a light receiving element. The line sensor is shown in the drawing, and an optical signal read by the line sensor is photoelectric-converted, and the signal is compared and checked with data of a legitimate bill stored in advance, which makes it possible to identify the authenticity of the bill to be carried.

The bill housing part 100 that houses bills is configured so as to be removable from the apparatus main body 2, and stacks and houses bills identified as being genuine (or legitimate) by the bill reading means 8 one after another.

As shown in FIGS. 4 and 6A, a main body frame 100A constituting the bill housing part 100 is formed into a substantially rectangular parallelepiped shape, and a placing plate 105 on which bills to be fed via the feed port 103 are stacked one after another, and a biasing means (biasing spring) 106 that pushes (or biases) the placing plate 105 toward a presser plate 115 which will be described later are provided inside the main body frame 100A.

In the main body frame 100A, a press holding part 108 that holds and has a bill wait as it is, the bill being to be dropped, is provided so as to be continued from the feed port 103. A pair of regulatory walls (only either of them is illustrated in FIG. 4, and the walls are omitted in FIG. 6A) 110 is disposed so as to extend in the vertical direction on both sides of the press holding part 108 on the placing plate side. The pair of regulatory walls 110 serves to contact both sides of an uppermost bill to stably hold the bills to be stacked when bills are placed one after another on the placing plate 105 and the placing plate 105 is biased by the biasing means 106.

Further, the presser plate 115 that presses bills dropping into the press holding part 108 from the feed port 103 toward the placing plate 105 is installed in the main body frame 100A. The presser plate 115 is formed in a size to be capable of passing through a space between the pair of regulatory walls 110, and gets into the space to be driven to reciprocate between a position at which the bills are pressed against the placing plate 105 (a pressing position) and another position at which the press holding part 108 is opened (an initial position).

As shown in FIGS. 4 and 6A, the presser plate 115 is driven to reciprocate as described above by a presser plate driving mechanism 120 installed in the main body frame 100A. The presser plate driving mechanism 120 includes a pair of link members 115*a* and 115*b*, both ends of which are supported pivotally by the presser plate, so as to allow the presser plate 115 to reciprocate in an arrow A direction, and these link members 115*a* and 115*b* are connected at the respective center positions in an X-shaped configuration such that the respective ends opposite to each other are supported pivotally by a movable member 122 installed to be movable in a vertical direction (an arrow B direction). A rack is formed in the movable member 122, and a pinion 124A constituting the presser plate driving mechanism 120 is engaged with the rack.

In addition, as shown in FIG. 6A, a housing part side gear train 124 constituting the presser plate driving mechanism 120 is connected to the pinion 124A. In this case, in the present embodiment, as shown in FIGS. 3 and 6A, a driving source (motor 20) and a main body side gear train 21 sequentially engaged with the motor 20 are installed in the apparatus main body 2, and when the bill housing part 100 is mounted on the apparatus main body 2, the main body side gear train 21 is connected to the housing part side gear train 124. That is, the presser plate 115 is driven to reciprocate in the arrow A directions by the motor 20 provided in the apparatus main body 2 by the presser plate driving mechanism 120 (link members 115*a* and 115*b*, the movable member 122, and the housing part side gear train 124) and the main body side gear train 21.

Next, the configuration of the above-described pair of rollers (14A and 14B) as the contact members and the contact member driving mechanism 70 will be described with reference to FIGS. 7 to 11.

Figure 7:
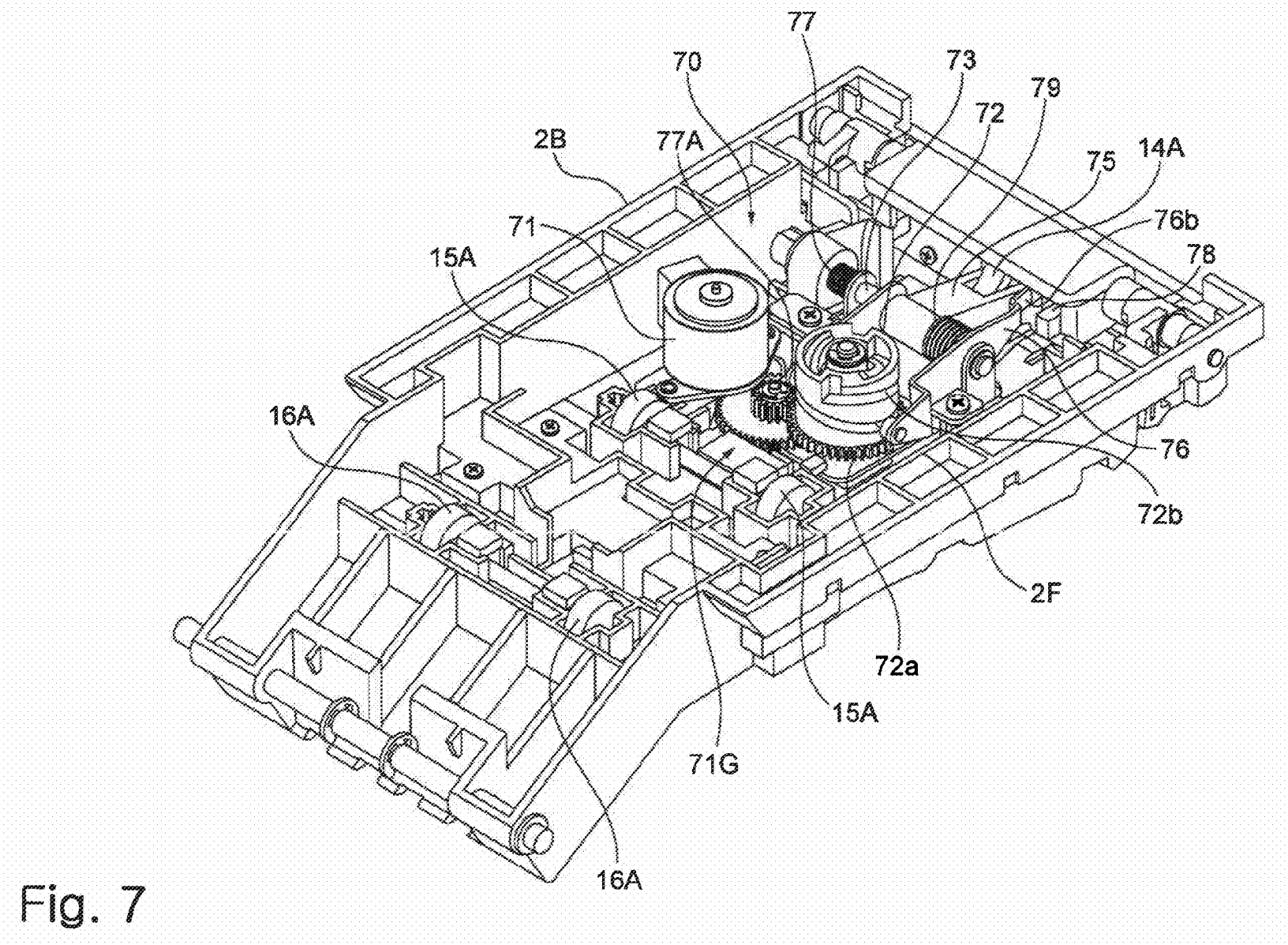
FIG. 7 is a perspective view showing an interior configuration of an open/close member installed in a main body frame.
Figure 8:
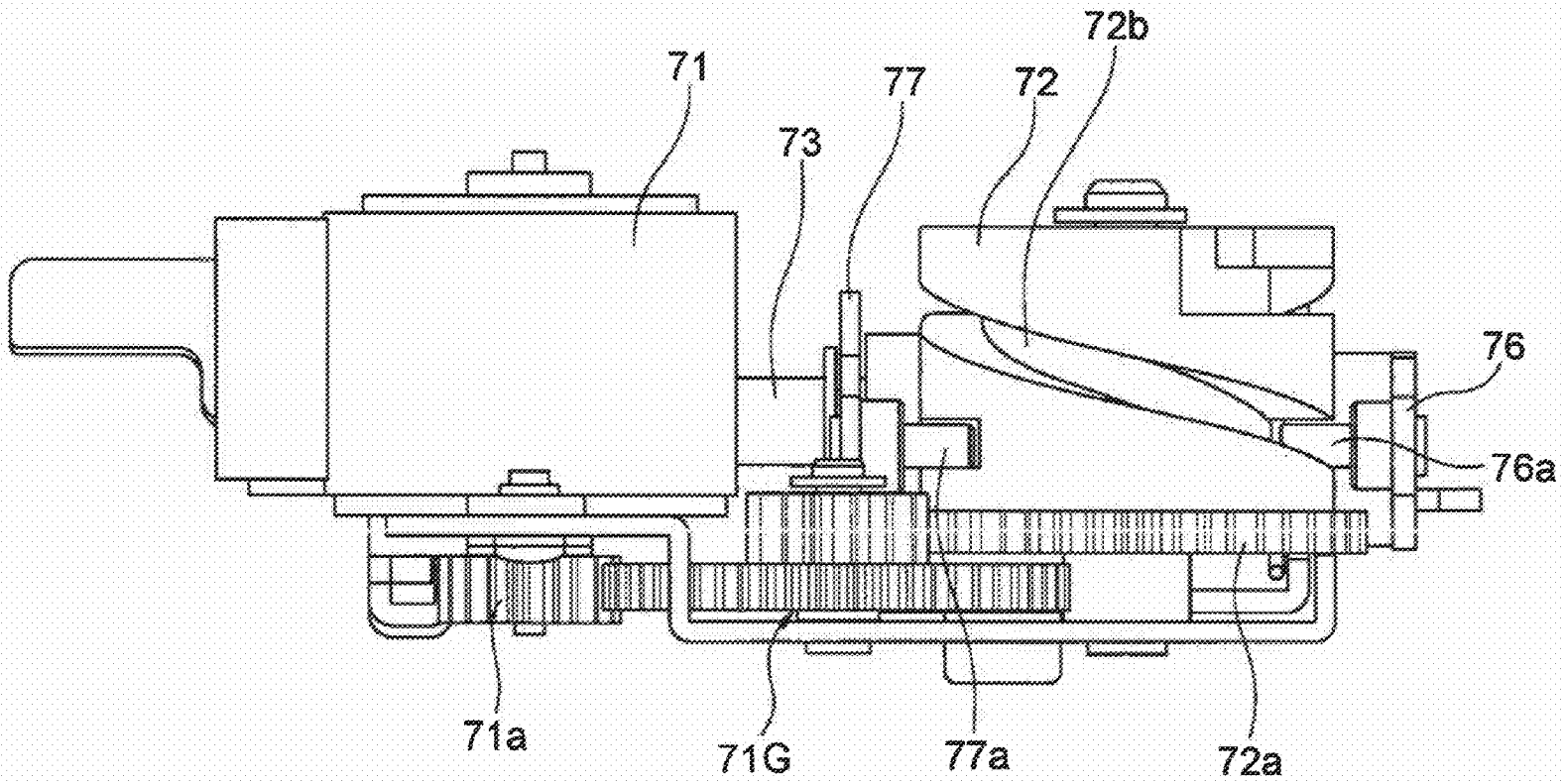
FIG. 8 is a back view showing an arrangement of a cam member and a driving source shown in FIG. 7.
Figure 9:
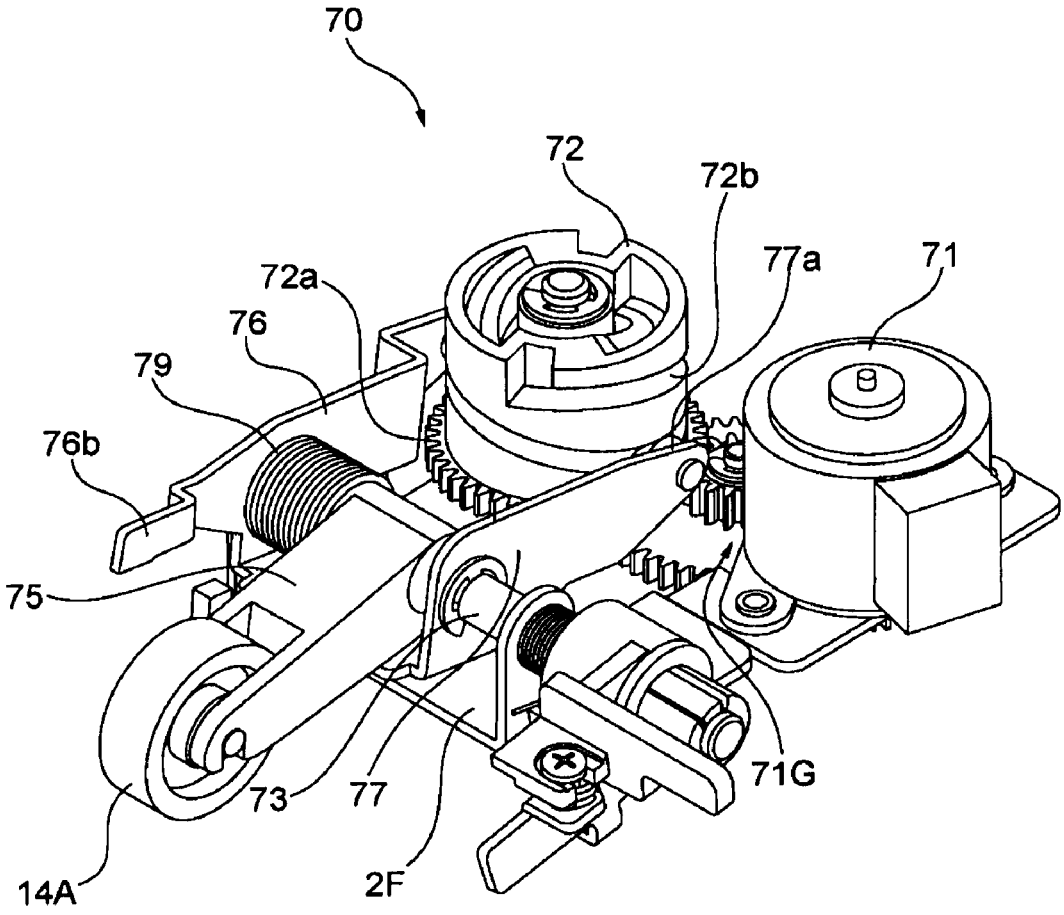
FIG. 9 is a perspective view showing an arrangement of a cam member and a driving source shown in FIG. 7.
Figure 10:
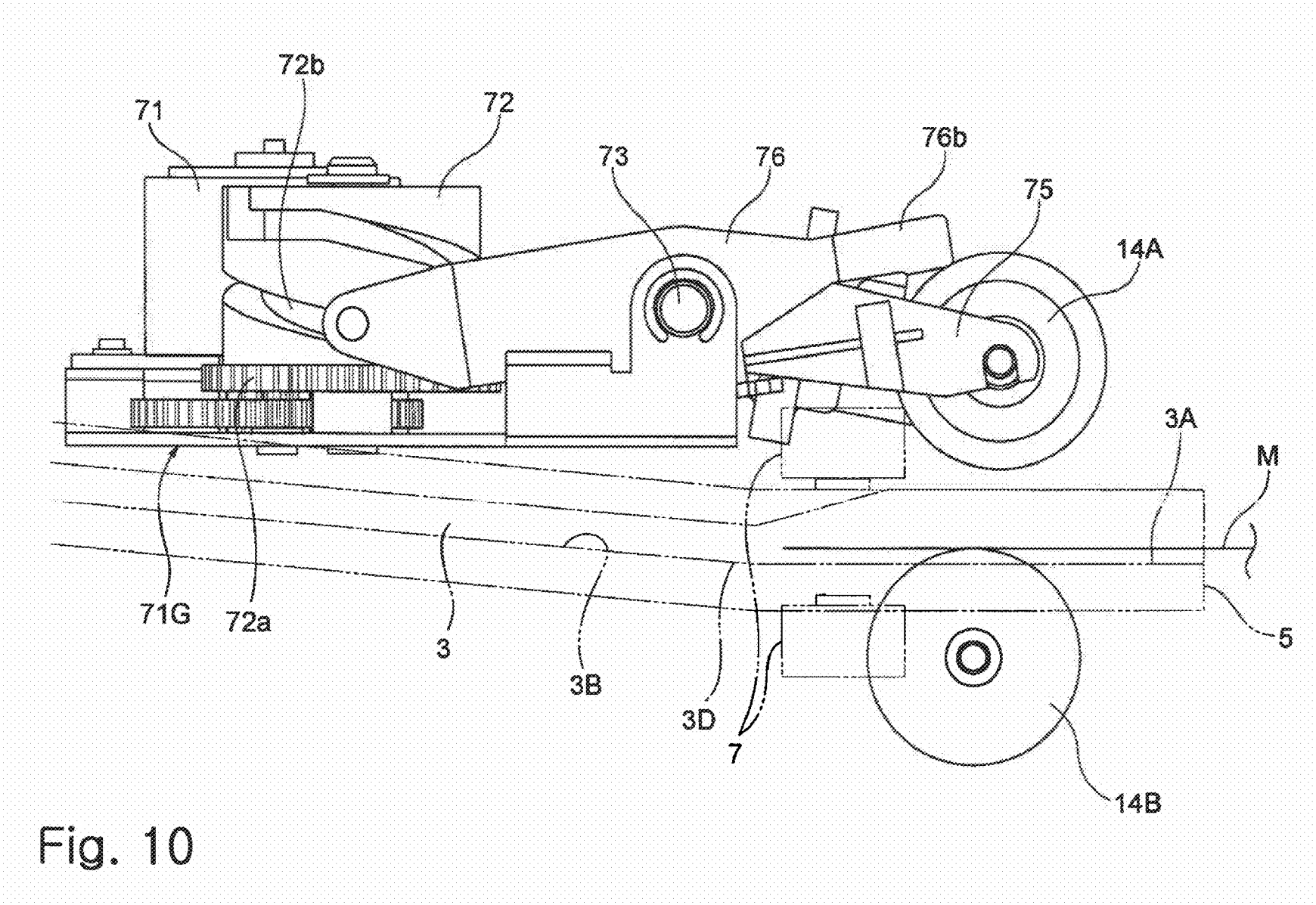
FIG. 10 is a side view showing a state where a pair of contact members are separated apart.
Figure 11:
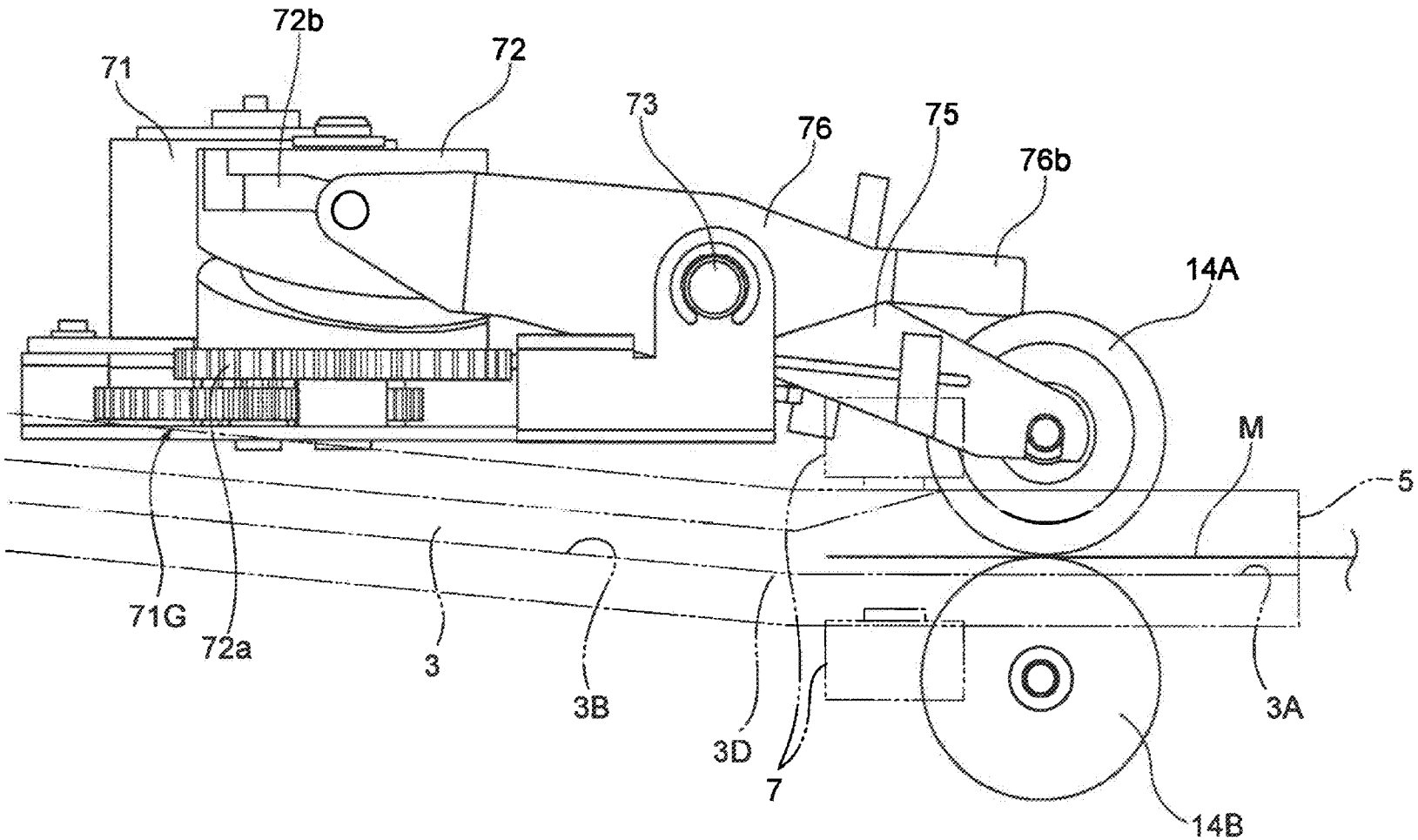
FIG. 11 is a side view showing a state where a bill is nipped with a pair of contact members.

With respect to these figures, FIG. 7 is a perspective view showing an interior configuration of an open/close member arranged to the main frame, FIG. 8 is a back view showing a configuration of a cam member and a driving source as shown in FIG. 7, FIG. 9 is a perspective view showing a configuration of the cam member and the driving source as shown in FIG. 7, FIG. 10 is a side view showing a state where the pair of contact members are spaced apart, and FIG. 11 is a side view showing a state where the bill is held (or nipped) by the pair of contact members.

As shown in FIG. 7, the upper roller 14A as a contact member of the aforementioned pair of contact members and the contact member driving mechanism 70 that drives the roller 14A to become close to or apart from the lower roller 14B as the other contact member are installed inside the open/close member 2B.

The contact member driving mechanism 70 includes a motor 71 serving as a driving source, and a cylindrical cam member 72 which is arranged next to the motor 71 and supported rotatably. An output gear 71*a* is fixed to the output shaft of the motor 71, and the output gear 71*a* is, as shown in FIG. 8, connected to an input gear 72*a* integrally fixed to the cam member 72 via a gear train 71G. Therefore, the cam member 72 is driven to rotate normally/reversely via the gear train 71G by the rotational driving of the motor 71. Here, a groove (grooved cam) 72*b* is formed spirally in the outer circumferential surface of the cam member 72.

Further, a spindle (or main shaft) 73 extending in a direction perpendicular to the bill traveling direction is provided at the bill insertion slot side at a frame 2F of the open/close member 2B. An arm 75 extending toward the bill insertion slot side is supported rotatably at the substantially center of the spindle 73, and the roller 14A is supported rotatably at the leading end thereof. Then, a pair of swing members 76 and 77 are supported with respect to the spindle 73 on both sides of the arm 75 so as to rotate the arm 75 centering on the spindle 73.

The pair of swing members 76 and 77 extends toward the side of the cam member 72, and protrusions 76*a* and 77*a* engaged with the groove 72*b* are formed in the ends of the swing members 76 and 77. Therefore, when the cam member 72 is driven to rotate by the rotational driving of the motor 71, the swing members 76 and 77 are swung in the up-and-down direction in synchronization therewith, and as shown in FIGS. 10 and 11, the arm 75, i.e., the roller 14A can be driven in the vertical direction. In this case, the rotary torque of the motor 71 is used for driving the cam member 72 connected to the gear train 71G as described above to rotate, and move the pair of swing members 76 and 77 up and down via the protrusions 76*a* and 76*b* engaged with the groove 72*b* formed in the outer circumferential surface of the cam member, to move the arm 75, i.e., the roller 14A up and down. Therefore, even when an attempt to move the roller 14A up and down is made for illicit purposes or the like, the swing members are difficult to swing because of the engagement with the cam, and the force is not transmitted to the motor 71, which makes it possible to effectively prevent the motor serving as the driving source from being broken and the like.

A detecting piece 76*b* to detect a position of the roller 14A, more specifically, that the roller 14A is close to the roller 14B so as to reach the position for holding (or nipping) a bill therebetween is formed to the swing member 76 as one of the pair of swing members. The detecting piece 76*b* moves in the up-and-down direction according to the swinging of the swing member 76, and when the roller 14A gets close to the roller 14B so as to hold (or nip) a bill therebetween, the state is detected by an optical sensor (a roller detecting sensor) 78 shown in FIG. 7. Here, the configuration of the detecting means that detects a position of the roller 14A is not limited to such configuration, but may be appropriately modified within the scope.

Further, a spring (constituted of a torsion coil spring) 79 that biases the arm 75, i.e., the roller 14A toward the roller 14B is installed between the arm 75 and the swing member 76. In this way, by installing the spring 79, as shown in FIG. 11, when the roller 14A moves so as to slidingly contact an inserted bill M, which moves so as to contact the other roller 14B, the roller 14A presses the bill M with biasing force of the spring 79, and is capable of being spaced from the roller 14B against the biasing force of the spring 79. Therefore, the roller 14A is capable of slidingly contacting the bill M with appropriate biasing force.

Here, the contact member driving mechanism 70 may comprise a solenoid or the like as a driving source that drives the roller 14A. However, by using a motor capable of rotating normally and reversely, it is possible to control the roller 14A to become close to and apart from the roller 14B by the motor rotating normally and reversely. That is, by configuring the driving source with the motor, it suffices to control the driving of the motor 71 to stop at a position such that the pair of contact members become close to each other so as to hold (or nip) the bill therebetween and at another position such that the pair of contact members become apart from each other, which saves unnecessary electrical power for controlling the contact member to be moved. Further, an attempt can be made to make the motor silent as compared with a solenoid.

Figure 12:
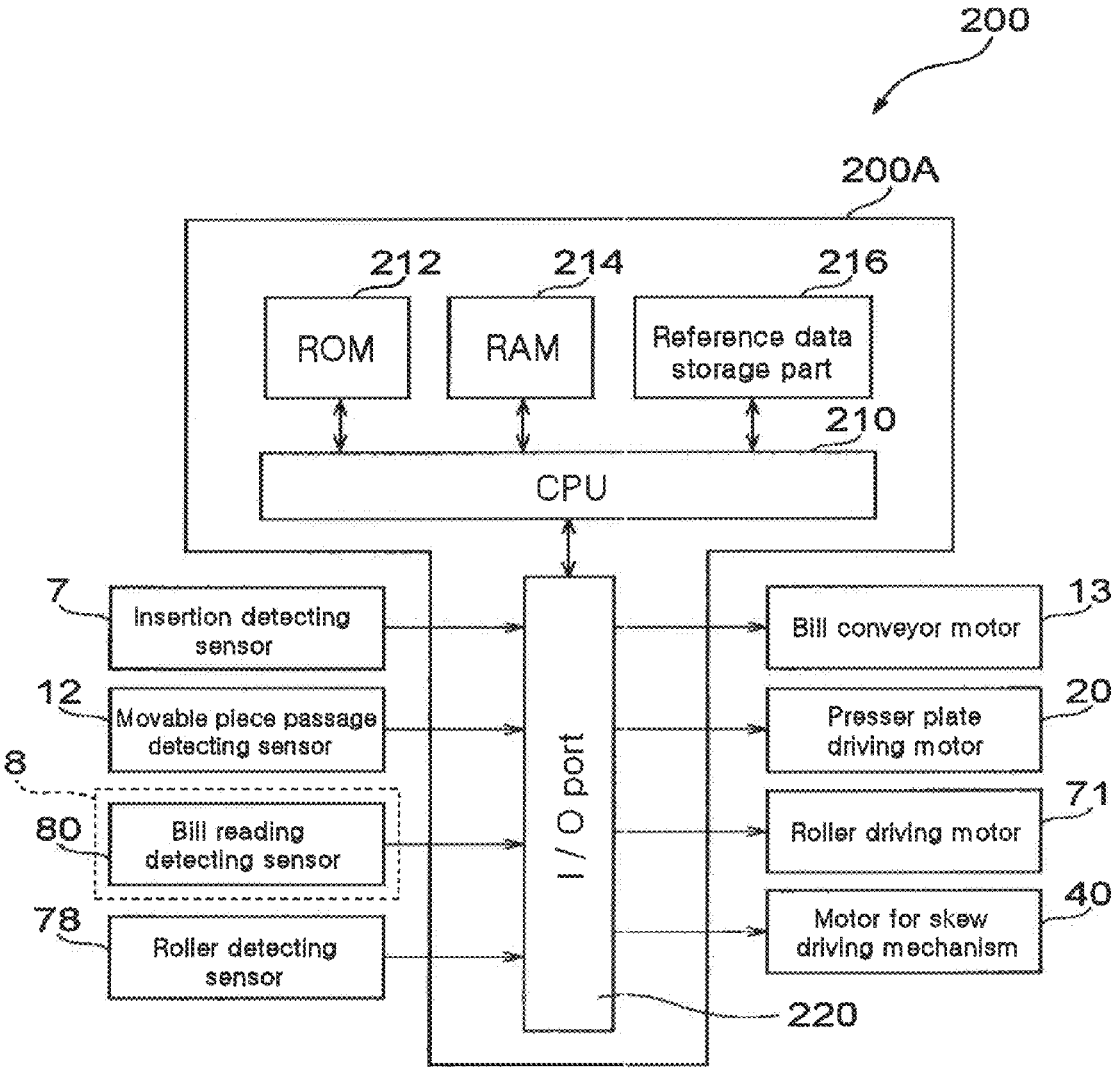
FIG. 12 is a diagram showing a configuration of control means for controlling drives of a bill conveyance mechanism, bill reading means, and a contact member driving mechanism.
Figure 13:
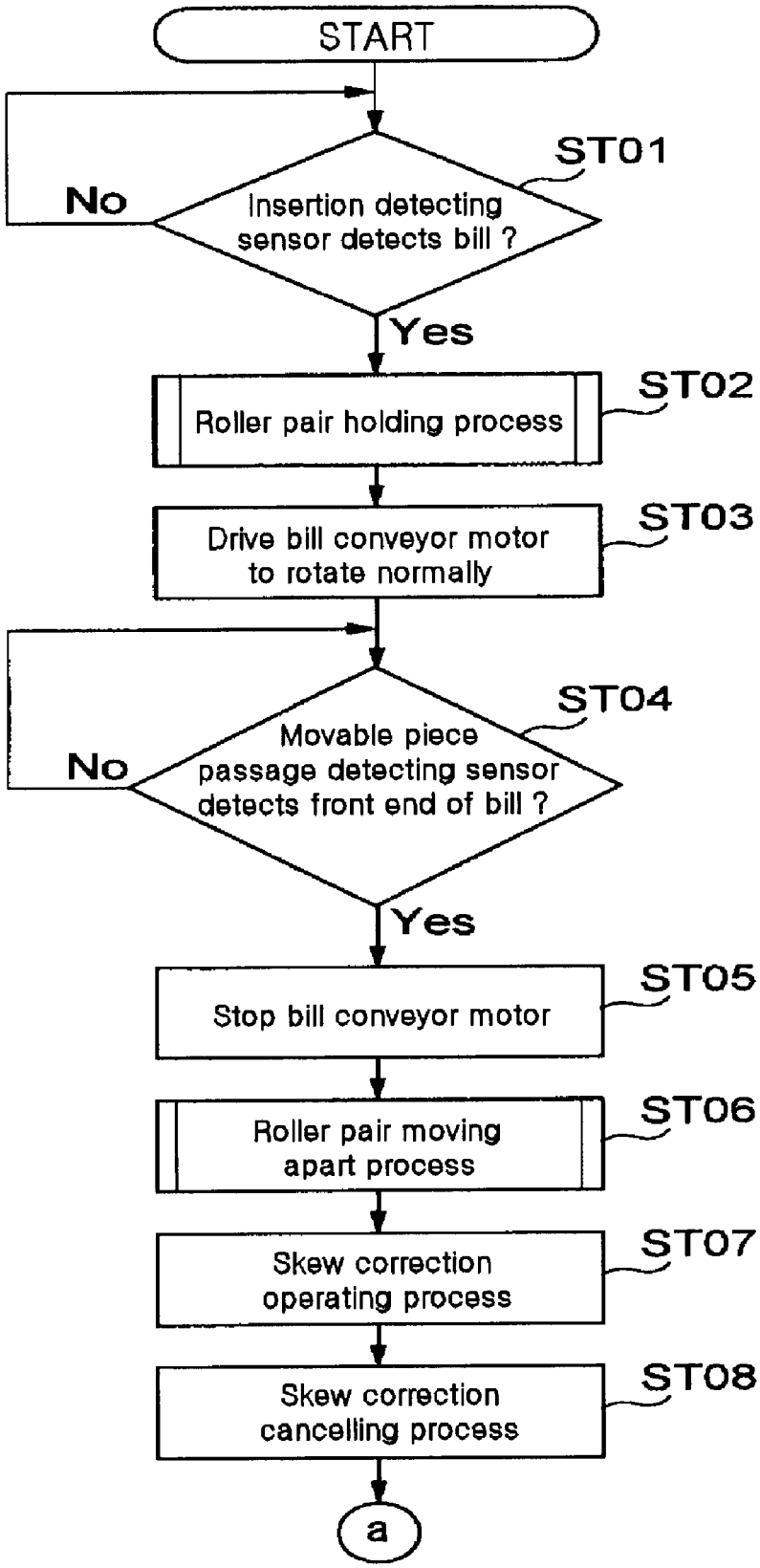
FIG. 13 shows a flowchart (part one) illustrating processing operations for processing a bill in a bill processing apparatus of this embodiment.
Figure 14:
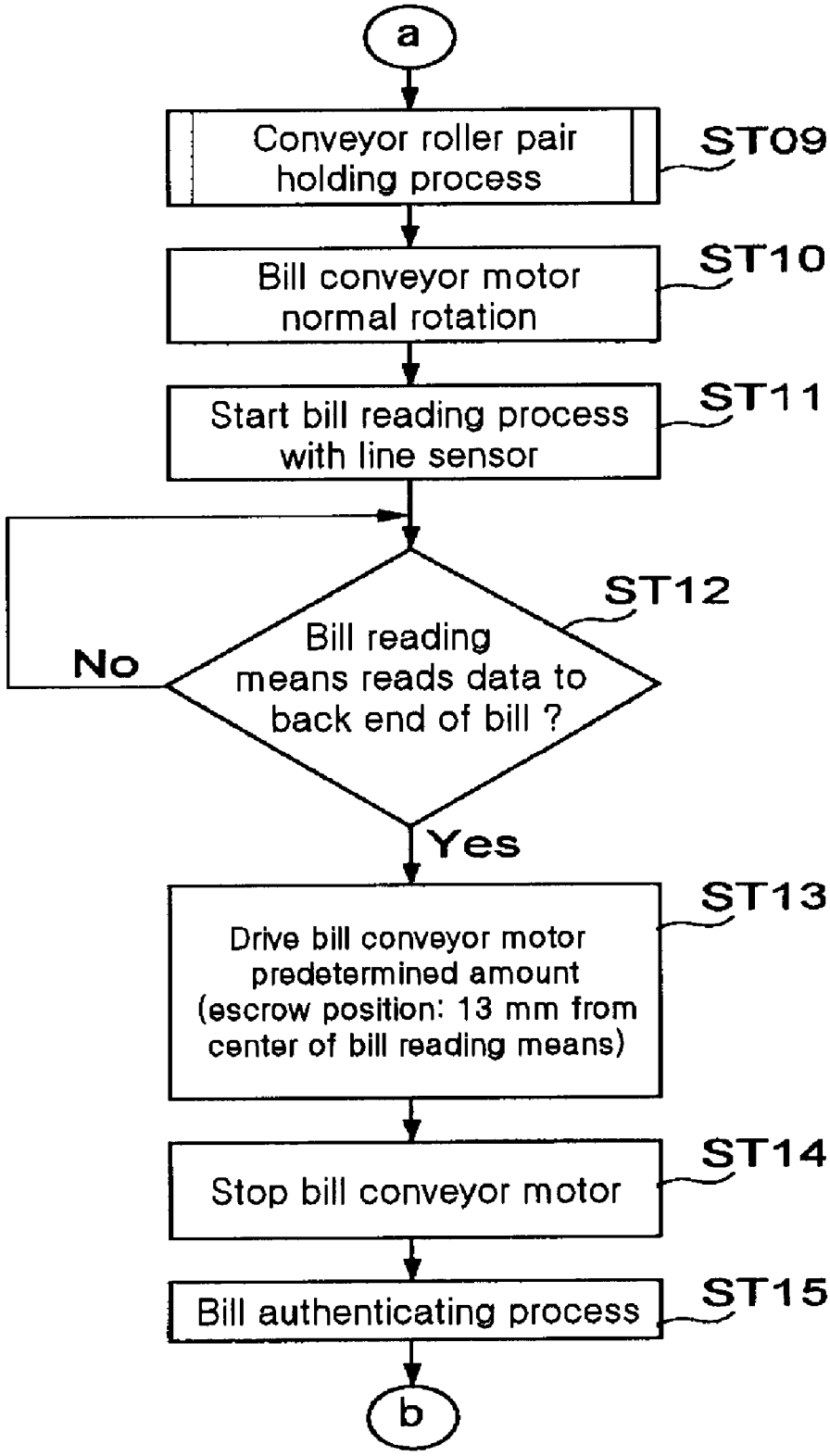
FIG. 14 shows a flowchart (part two) illustrating processing operations for processing a bill in a bill processing apparatus of this embodiment.
Figure 15:
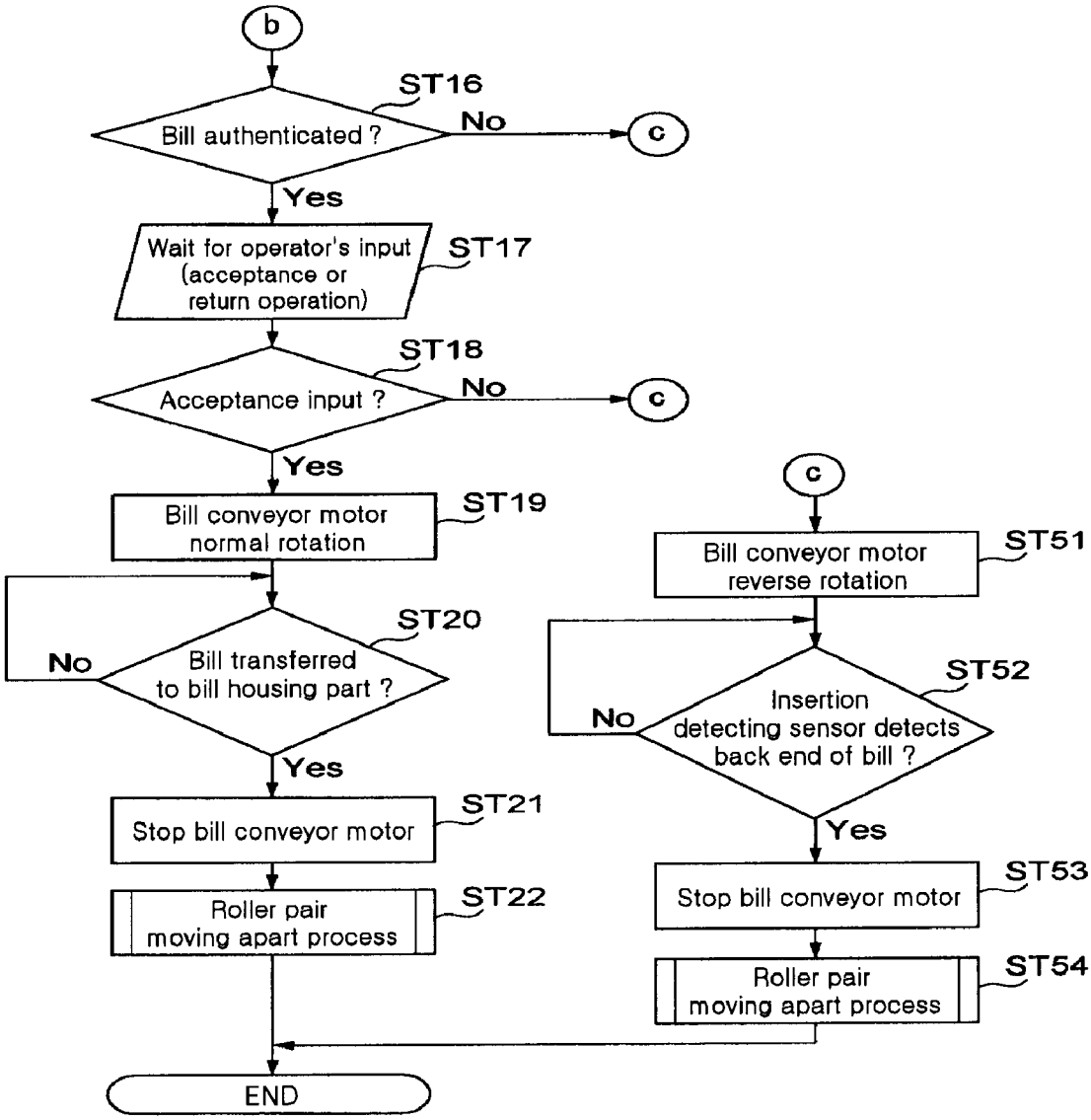
FIG. 15 shows a flowchart (part three) illustrating processing operations for processing a bill in a bill processing apparatus of this embodiment.

Next, the control means (or control device) that controls the driving of the bill conveyance mechanism 6, the bill reading means 8, and the contact member driving mechanism 70 will be described with reference to FIG. 12.

The control means 200 includes a control circuit board 200A that controls the operation of the respective drive units described above, and a CPU (Central Processing Unit) 210 constituting bill identification means, a ROM (Read Only Memory) 212, a RAM (Random Access Memory) 214, and a reference data storage part 216 are mounted on the control circuit board.

In the ROM 212, various types of programs such as operation programs for the respective types of drive units such as the motor 13 that drives the above-described bill conveyance mechanism, the motor 20 that drives the presser plate, the roller driving motor 71 that drives the conveyor roller 14A as a part of the pair of rollers to come close to/to be spaced apart from the conveyor roller 14B, and the motor 40 that drives the skew driving mechanism 10 and an authenticity judgment program for identifying the bill that is read by the bill reading means 8; and permanent data are stored. The CPU 210 generates control signals according to the programs stored in the ROM 212, and carries out input and output of the signals to and from the respective drive units via an I/O port 220, in order to control the driving of the respective drive units.

Further, sensed signals from the insertion detecting sensor 7, the movable piece passage detecting sensor 12, and the roller detecting sensor 78 are input into the CPU 210 via the I/O port 220, and the driving control of the respective drive units is preformed on the basis of these sensed signals.

Further, data and programs used for the CPU 210 to operate are stored in the RAM 214, and reference data used for performing a bill authenticity judgment, for example, various types of data acquired from all the printed areas in the legitimate bill (for example, data about contrast and data about transmitted light and reflected light when the bill is irradiated with infrared ray) are stored as reference data in the reference data storage part 216. In addition, the reference data is stored in a dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216, which allows a bill authenticity judgment process to be executed.

In addition, the control means 200 that controls the operation of the bill processing apparatus is mounted on one control circuit board 200A. However, the control means 200 may be arranged in a dispersive manner on separate control circuit boards in accordance with respective functions thereof.

Next, the bill processing operation in the bill processing apparatus 1 executed by the control means 200 will be described in reference to the flowcharts of FIGS. 13 to 17.

When an operator inserts a bill into the bill insertion slot 5, the pair of rollers (14A and 14B) installed between the bill insertion slot 5 and the insertion detecting sensor 7 is in a state where the rollers are apart from each other as in an initial state (refer to ST22 and ST54 which will be described later).

Further, as described above, the bill traveling route 3 formed continuously from the bill insertion slot 5 is constituted of the first traveling route 3A and the second traveling route 3B, and as shown in FIG. 6A, the length L1 in the bill thickness direction of the first traveling route 3A is set to be longer than the length L2 in the bill thickness direction of the second traveling route 3B. In this way, because the above-described pair of rollers (14A and 14B) is in a spaced state even when the length in the bill thickness direction on the upstream side of the bill traveling route 3 is set to be longer, it is easy to insert a bill from the bill insertion slot 5, and because the length L2 in the bill thickness direction is set to be shorter on the downstream side (the second traveling route 3B), it is possible to effectively prevent foreign matter from invading the inside of the apparatus from the bill insertion slot 5.

Moreover, as shown in FIG. 6A, because the bill traveling route 3 is arranged to be bent at the bent portion 3D on the upstream side from the bill reading detecting sensor (line sensor) 80 that identifies the authenticity of the paper sheet, even if a thin rigid member such as a ruler is inserted into the bill traveling route by way of vandalization or fraudulent activity, the member cannot be inserted beyond the bent portion 3D, which makes it possible to effectively prevent the important components such as the bill reading detecting sensor 80 from being tampered.

Then, when the operator inserts a bill and the insertion of the bill is detected by the insertion detecting sensor 7 (ST01) in a state where the pair of rollers (14A and 14B) is in a spaced state as described above, a holding process by the pair of rollers is executed (ST02).

Figure 16:
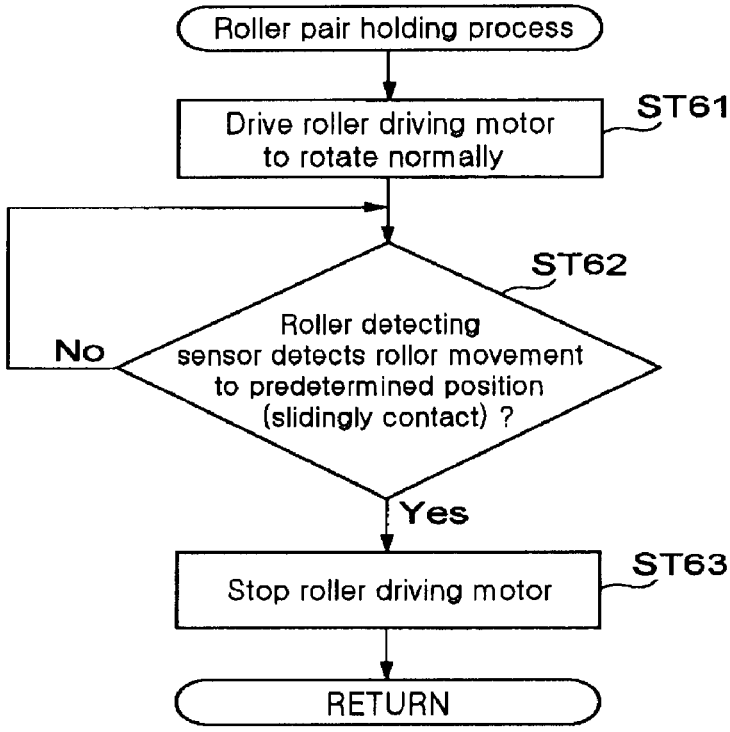
FIG. 16 shows a flowchart illustrating processing operations of a nipping process of a pair of rollers.
Figure 17:
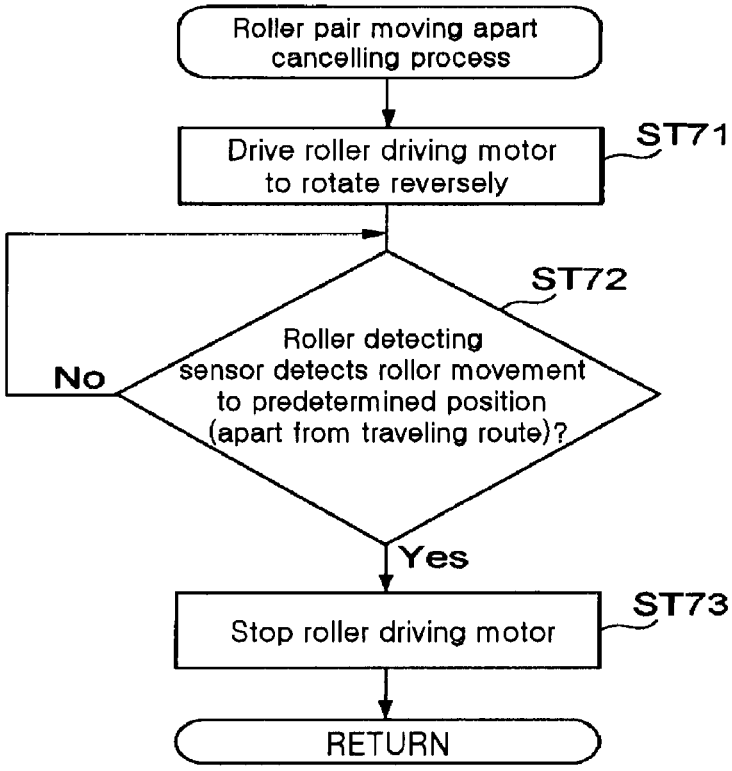
FIG. 17 shows a flowchart illustrating processing operations of a releasing process of a pair of rollers.

The holding process by the pair of rollers is executed in accordance with the procedure shown in FIG. 16. That is, the motor 71 for driving the rollers is driven to rotate normally (ST61), to move the upper roller 14A toward the lower roller 14B by the cam member 72 and the pair of swing members 76 and 77, and when the roller detecting sensor 78 detects the detecting piece 76*b*, the motor 71 for driving the rollers is stopped (ST62, ST63).

In accordance therewith, the inserted bill is held between the pair of rollers (14A and 14B) as shown in FIG. 11. When the operator inserts the bill into the insertion slot 5, the roller 14A is moved to the other roller 14B to hold (or nip) the bill therebetween after it is confirmed by the insertion detecting sensor 7 that the bill is inserted in the bill traveling route 3. Because the pair of rollers (14A and 14B) are spaced therebetween until the existence of the bill is detected, the bill can be surely inserted between the pair of rollers (14A and 14B) even if the bill is folded, twisted, or wrinkled. Thereafter, by moving the roller 14A as a part of the pair of rollers toward the other, the bill is held (or nipped) between the pair of rollers (14A and 14B), which achieves reliable conveyance.

Here, since the pair of rollers (14A and 14B) are installed between the bill insertion slot 5 and the insertion detecting sensor 7, the pair of rollers (14A and 14B) is in a spaced state until the operator inserts the bill into the bill insertion slot and the bill passes through the position of the pair of rollers. Therefore, the bill can be inserted more smoothly.

When the bill is held (or nipped) between the pair of rollers (14A and 14B), the bill conveyor motor 13 is driven to rotate normally (ST03). The bill is conveyed toward the inside of the apparatus by the pair of rollers (14A and 14B), and when the movable piece passage detecting sensor 12 disposed on the downstream side from the skew correction mechanism 10 detects the leading end of the bill, the bill conveyor motor is stopped (ST04, ST05). At this time, the bill is located between the pair of movable pieces 10A constituting the skew correction mechanism 10.

Next, a spacing process of the pair of rollers is executed (ST06). The spacing process of the pair of rollers is executed in accordance with the procedure shown in FIG. 17. That is, the motor 71 for driving the rollers is driven to rotate reversely (ST71), to move the upper roller 14A so as to be apart from the lower roller 14B by the cam member 72 and the pair of swing members 76 and 77, and when the roller detecting sensor 78 detects that the detecting piece 76*b* is separated, the motor 71 for driving the rollers is stopped (ST72, ST73). By this operation, the roller 14A is spaced from the roller 14B such that no load is applied to the bill.

Then, a skew correction operating process is executed in this state (ST07). The skew correction operating process is achieved by driving the motor 40 for the skew correction mechanism to rotate normally to drive the pair of movable pieces 10A to become close to each other. That is, the bill is moved so as to be positioned in the center by the movable pieces 10A contacting both sides of the bill, and its skew is corrected thereby, and the bill is positioned at the accurate center position.

When the skew correction operating process as described above is completed, next, a skew correction canceling process is executed (ST08). This process is executed by moving the pair of moveable pieces 10A apart from each other by making the motor 40 for the above-mentioned skew correction mechanism driven to rotate reversely such that the pair of moveable pieces 10A are moved apart.

Next, the roller pair holding processes (ST61-ST63) are executed such that the roller 14A is moved so as to contact the roller 14B such that the bill is held (or nipped) by the pair of rollers (14A, 14B) (ST09). Thereafter, the bill conveyor motor 13 is driven to normally rotate to convey the bill toward the inside of the apparatus, and when the bill passes through the bill reading means 8, a bill reading process is executed (ST10 and ST11).

Then, when the carried bill passes the bill reading means 8 and the bill reading means 8 reads the data up to the back end of the bill, the bill conveyor motor 13 is driven by a predetermined amount so as to stop the bill at a predetermined position (an escrow position; a position at which the bill is conveyed toward the downstream by 13 mm from the center position of the bill reading means 8), and at this time, a bill authenticity judgment process is executed in the control means 200 (ST12 to ST15).

In the bill authenticity judgment process at ST15 described above, when the bill is judged as a legitimate bill (ST16; Yes), an input from the operator is received (ST17). This input corresponds to an acceptance operation in which the operator presses an acceptance button in order to accept provision of service (for example, an acceptance process according to the start of a game in a case of a gaming unit), and a process in which the operator presses a return button in order to execute a process for returning the inserted bill.

Then, when an operation to accept the provision of various types of services is input (ST18; Yes), the bill conveyor motor 13 is driven to normally rotate to convey the bill toward the bill housing part 100 (ST19). Thereafter, when it is sensed that the bill is transferred to the bill housing part 100 (transferred to the press holding part 108 through the feed port 103) (ST20), the driving to normally rotate the above-described bill conveyor motor 13 is stopped (ST21) as well as the spacing process of the pair of rollers is executed (ST22, ST71-ST73), and the series of processes is completed.

Also, in the process of ST16, when the bill is judged as a non-legitimate bill (ST16; No) or the operator presses the return button (ST17; No), the bill conveyor motor 13 is driven to rotate reversely such that the bill staying at the escrow position is conveyed toward the bill insertion slot 5 (ST51). Then, when the insertion detecting sensor 7 detects the back end of the bill returned toward the bill insertion slot 5 (ST52; Yes), the reverse rotation of the bill conveyor motor 13 is stopped (ST53) and the roller pair moving apart process is executed (ST54, ST71-ST73) such that the pair of rollers holding the bill are moved apart, and the series of processes are completed.

The embodiment of the present invention has been described above. However, the present invention is not limited to the above-described embodiment, and various modifications can be implemented. In the above-described embodiment, the pair of contact members installed in the vicinity of the bill insertion slot 5 to hold the bill therebetween has been described as the roller pair (14A and 14B). However, the pair of contact members may be appropriately modified such that one of the contact members may be a roller member and the other may be a belt member as well as both may be belt members. Further, in the above-described embodiment, the lower roller 14B is configured to be driven to rotate. However, the upper roller 14A may be configured to be driven to rotate.

Moreover, the driving source that drives the various types of driving members or the mechanism for transmitting power from the driving source have been merely shown as examples, and modifications thereof can be appropriately made.

The paper sheet processing apparatus of the present invention is not limited to the above-described paper sheet processing apparatus, and may be incorporated into various types of apparatuses that process sheet-like members such as papers or cards other than bills.

In the paper sheet processing apparatus of the present embodiment, the following features may also be incorporated.

When a user inserts a folded or twisted paper sheet into the insertion slot of a paper sheet processing apparatus, height (or thickness) of the paper sheet insertion slot may be shorter than a thickness of the folded or twisted paper sheet such that the paper sheet may not be able to be drawn into the inside of the apparatus. Therefore, the paper sheet processing apparatus may not be able to convey the bill toward the paper sheet identification part.

In the present embodiment, even if a heavily damaged paper sheet may be conveyed toward the inside of the paper sheet processing device.

A paper sheet processing apparatus according to this embodiment comprises: an insertion slot into which a paper sheet is inserted, a paper sheet conveyance mechanism which conveys the paper sheet inserted into the insertion slot, a paper sheet traveling route through which the paper sheet is conveyed to move by the paper sheet conveyance mechanism, a sensor which detects the paper sheet existence in the paper sheet traveling route, a pair of contact members which holds the paper sheet inserted into the insertion slot therebetween, a driving source which moves one of the pair of contact members toward the other contact member, and a control device which controls the driving of the driving source. And in the paper sheet processing apparatus, either of the pair of contact members is driven to convey the paper sheet by the paper sheet conveyance mechanism. The control device keeps the pair of contact members apart until the paper sheet is inserted into the insertion slot. When the paper sheet is inserted into the insertion slot and the existence of the paper sheet in the paper sheet traveling route is detected by the sensor, the control device controls one of the pair of contact members to move toward the other so as to hold (or nip) the paper sheet therebetween.

In accordance with the paper sheet processing apparatus having the above-described configuration, when the user inserts the paper sheet into the insertion slot, one of the pair of contact members is moved toward the other contact member so as to hold the paper sheet between the pair of contact members after the existence of the paper sheet in the paper sheet traveling route is confirmed by the sensor. That is, since the pair of contact members is spaced therebetween until the existence of the paper sheet is detected, even if the paper sheet inserted into the insertion slot is folded, twisted, or wrinkled, the paper sheet can be surely inserted into the pair of contact members, and thereafter, when one contact member moves toward the other contact member, the paper sheet is held between the contact members, which achieves reliable conveyance.

Further, the pair of contact members are installed inside the insertion slot, but outer than the paper sheet detecting sensor.

In such configuration, until a paper sheet is inserted into an insertion slot and the paper sheet passes through the position of the pair of contact members to be inserted, the pair of contact members are kept apart from each other such that the paper sheet can be inserted more smoothly.

Further, the paper sheet traveling route comprises a first traveling route provided so as to be connected to the insertion slot, and a second traveling route extending from the other end of the first traveling route, and height of the first traveling route is set to be higher than that of the second traveling route.

In such configuration, it is easy to insert the paper sheet from the insertion slot even if the height of the bill traveling route on the upstream side is set to be larger since the pair of contact members are spaced therebetween. Further, such configuration can effectively prevent foreign matter from invading the inside of the apparatus from the insertion slot since the height of the bill traveling route is set to be shorter on the downstream side.

Further, a paper sheet identification part that identifies the authenticity of a paper sheet is provided in the paper sheet traveling route. And the paper sheet traveling route is bent on the upstream side from the paper sheet identification part.

In such configuration, even if a thin rigid member such as a ruler is inserted into the paper sheet traveling route by way of vandalization or fraudulent activity, the member cannot be inserted beyond the predetermined position since the paper sheet traveling route is bent at the predetermined position. In particular, since important components such as a line sensor and the like are installed in the paper sheet identification part and the paper sheet traveling route is bent on the upstream side therefrom, it is possible to prevent the important components from being damaged.

Further, the paper sheet conveyance mechanism includes a swing member pivotally supporting one of the pair of contact members. The contact member pivotally supported by the swing member is pressed against the other contact member by a spring.

In such configuration, when one of the pair of contact members moves so as to slidingly contact the inserted paper sheet (moves so as to contact the other contact member), the moving contact member presses the paper sheet with biasing force of the spring, and can be spaced from the other contact member against the biased force by the spring. Therefore, the moving contact member can slidingly contact the paper sheet with appropriate biased force.

Further, the driving source comprises a motor which enables one of the pair of contact members to move toward the other contact member.

In such configuration, one of the contact members moves toward the other contact member by driving the motor. At a position where the pair of contact members contact with each other, it suffices to stop the driving of the motor since a position of the conveyor member is not controlled by a solenoid. Therefore, it is not necessary to provide electrical power for controlling the moving contact member.

In accordance with the present embodiment, a paper sheet processing apparatus capable of stably conveying even a severely-damaged paper sheet toward the inside of the apparatus can be obtained.

What is claimed is:

1. A paper sheet processing apparatus comprising:

an insertion slot into which a paper sheet is inserted;

a paper sheet conveyance mechanism for conveying the paper sheet inserted into the insertion slot;

a paper sheet traveling route through which the paper sheet is conveyed by the paper sheet conveyance mechanism;

a sensor for detecting the paper sheet existing in the paper sheet traveling route;

a pair of contact members for holding the paper sheet inserted into the insertion slot, the pair of contact members being installed between the insertion slot and the sensor;

a driving source for moving one of the pair of contact members toward the other; and a control device for controlling driving of the driving source, wherein at least either of the pair of contact members is driven to convey the paper sheet by the paper sheet conveyance mechanism, and wherein the control device controls the driving force to move the at least either of the pair of contact members such that the pair of contact members are kept apart from each other before the paper sheet is inserted into the insertion slot and that the pair of contact members become closer to each other so as to hold the paper sheet in response to the sensor detecting that the paper sheet is inserted into the insertion slot.

2. The paper sheet processing apparatus according to claim 1 wherein:

the paper sheet traveling route comprises a first traveling route having one end connected to the insertion slot and a second traveling route connected to and extending from the other end of the first traveling route, and a height of the first traveling route is larger than that of the second traveling route.

3. The paper sheet processing apparatus according to claim 2 wherein the paper sheet traveling route comprises a paper sheet identification part for judging whether the paper sheet is legitimate or not and a bent portion that is arranged closer to the insertion slot than the paper sheet identification part.

4. The paper sheet processing apparatus according to claim 2 wherein the paper sheet conveyance mechanism comprises a swing member for supporting rotatably either of the pair of contact members, and the either of the pair of contact members supported rotatably by the swing member is pressed on the other by a spring.

5. The paper sheet processing apparatus according to claim 4, wherein:

the paper sheet conveyance mechanism comprises a cylindrical cam member having a spirally formed groove, with which a protrusion of the swing member engages; and an arm supporting one of the contact members on a leading end thereof, the arm being rotated by the swing member, and the driving source drives the cylindrical cam member to rotate such that the swing member is swung so as to rotate the arm such that the one of the contact members may be closer to or apart from the other of the contact members.

6. The paper sheet processing apparatus according to claim 1 wherein the paper sheet traveling route comprises a paper sheet identification part for judging whether the paper sheet is legitimate or not and a bent portion that is arranged closer to the insertion slot than the paper sheet identification part.

7. The paper sheet processing apparatus according to claim 6 wherein the paper sheet conveyance mechanism comprises a swing member for supporting rotatably either of the pair of contact members, and the either of the pair of contact members supported rotatably by the swing member is pressed on the other by a spring.

8. The paper sheet processing apparatus according to claim 7, wherein:

the paper sheet conveyance mechanism comprises a cylindrical cam member having a spirally formed groove, with which a protrusion of the swing member engages; and an arm supporting one of the contact members on a leading end thereof, the arm being rotated by the swing member, and the driving source drives the cylindrical cam member to rotate such that the swing member is swung so as to rotate the arm such that the one of the contact members may be closer to or apart from the other of the contact members.

9. The paper sheet processing apparatus according to claim 1 wherein the paper sheet conveyance mechanism comprises a swing member for supporting rotatably either of the pair of contact members, and the either of the pair of contact members supported rotatably by the swing member is pressed on the other by a spring.

10. The paper sheet processing apparatus according to claim 9 wherein the swing member is moved by rotation of a helical gear.

11. The paper sheet processing apparatus according to claim 9, wherein:

the paper sheet conveyance mechanism comprises a cylindrical cam member having a spirally formed groove, with which a protrusion of the swing member engages; and an arm supporting one of the contact members on a leading end thereof, the arm being rotated by the swing member, and the driving source drives the cylindrical cam member to rotate such that the swing member is swung so as to rotate the arm such that the one of the contact members may be closer to or apart from the other of the contact members.

12. The paper sheet processing apparatus according to claim 1 wherein the driving source comprises a motor capable of moving either of the pair of contact members toward the other.

13. The paper sheet processing apparatus according to claim 1 comprising:

a skew correction mechanism for eliminating skew of a bill, wherein:

the paper sheet traveling route comprises a first traveling route having one end connected to the insertion slot and a second traveling route connected to and extending from the other end of the first traveling route, a height of the first traveling route is larger than that of the second traveling route, and the height of the second traveling route is arranged such that a thin rigid plate inserted from the insertion slot would not reach the skew correction mechanism.

* * * * *